US008923746B2

(12) United States Patent
Nakamura et al.

(10) Patent No.: US 8,923,746 B2
(45) Date of Patent: Dec. 30, 2014

(54) SHEET FEEDING MECHANISM AND IMAGE FORMING APPARATUS INCORPORATING SAME

(71) Applicants: Mitsutaka Nakamura, Hyogo (JP); Haruyuki Honda, Osaka (JP); Toshikane Nishii, Osaka (JP); Hirofumi Horita, Osaka (JP); Ippei Kimura, Osaka (JP); Masanori Namba, Osaka (JP)

(72) Inventors: Mitsutaka Nakamura, Hyogo (JP); Haruyuki Honda, Osaka (JP); Toshikane Nishii, Osaka (JP); Hirofumi Horita, Osaka (JP); Ippei Kimura, Osaka (JP); Masanori Namba, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 20 days.

(21) Appl. No.: 13/724,024

(22) Filed: Dec. 21, 2012

(65) Prior Publication Data

US 2013/0164066 A1 Jun. 27, 2013

(30) Foreign Application Priority Data

| | | |
|---|---|---|
| Dec. 22, 2011 | (JP) | 2011-281630 |
| Mar. 27, 2012 | (JP) | 2012-071848 |
| Jun. 1, 2012 | (JP) | 2012-125958 |

(51) Int. Cl.

| | |
|---|---|
| ***G03G 15/00*** | (2006.01) |
| ***G03G 15/08*** | (2006.01) |
| ***B65H 5/06*** | (2006.01) |
| ***B65H 5/26*** | (2006.01) |
| ***B65H 7/00*** | (2006.01) |
| ***G03G 21/16*** | (2006.01) |

(52) U.S. Cl.

CPC ..... *G03G 15/6529* (2013.01); *B65H 2404/144* (2013.01); *B65H 2404/142* (2013.01); *B65H 5/062* (2013.01); *B65H 5/26* (2013.01); *B65H 2404/6111* (2013.01); *B65H 7/00* (2013.01); *G03G 21/1638* (2013.01); *B65H 2402/441* (2013.01)

USPC ..... 399/405; 399/394; 399/395; 399/121; 399/124

(58) Field of Classification Search

CPC ..... G03G 21/1633

USPC ..... 399/121, 401, 114, 22, 23, 394, 395, 399/124, 67; 400/691

See application file for complete search history.

(56) References Cited

U.S. PATENT DOCUMENTS 7,430,385 B2 * 9/2008 Yamaoka ..... 399/110

(Continued)

FOREIGN PATENT DOCUMENTS

| | | |
|---|---|---|
| JP | 7-261504 | 10/1995 |
| JP | 2000-231321 | 8/2000 |

(Continued)

*Primary Examiner* — Matthew G Marini

(74) *Attorney, Agent, or Firm* — Harness, Dickey & Pierce, P.L.C.

(57) ABSTRACT

A sheet feeding mechanism incorporatable in an image forming apparatus includes a cover unit rotatably attached to one side of a main body of an image forming apparatus to cover a part of a sheet conveyance path, a first feeding member located in a main body of the apparatus, a second feeding member located in the cover unit in a displaceable manner and facing the first feeding member when the cover unit is closed and sandwiching and conveying a recording medium along the sheet conveyance path with the first feeding member, and a guide member disposed in the main body to guide the second feeding member. The guide member guides the second feeding member to move in a first direction that approaches the first feeding member when closing the cover unit and in a second direction that separates from the first feeding member when opening the cover unit.

17 Claims, 17 Drawing Sheets

(56) References Cited

U.S. PATENT DOCUMENTS

| | | | | |
|---|---|---|---|---|
| 8,437,659 | B2 * | 5/2013 | Fukunaga | 399/110 |
| 2006/0093397 | A1 * | 5/2006 | Yamaoka | 399/110 |
| 2007/0092292 | A1 * | 4/2007 | Ito | 399/124 |
| 2009/0022514 | A1 * | 1/2009 | Fujiwara et al. | 399/121 |
| 2010/0003051 | A1 * | 1/2010 | Sekina et al. | 399/121 |

FOREIGN PATENT DOCUMENTS

| | | |
|---|---|---|
| JP | 2004-020574 | 1/2004 |
| JP | 2006-030643 | 2/2006 |
| JP | 2006-290516 | 10/2006 |
| JP | 2007-148196 | 6/2007 |
| JP | 2011-085815 | 4/2011 |

* cited by examiner

SHEET FEEDING MECHANISM AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2011-281630, 2012-071848, and 2012-125958, filed on Dec. 22, 2011, Mar. 27, 2012, and Jun. 1, 2012, respectively in the Japan Patent Office, the entire disclosures of which are hereby incorporated by reference herein.

BACKGROUND OF THE INVENTION

1. Field of the Invention

Embodiments of the present invention relate to a sheet feeding mechanism and an image forming apparatus incorporating the sheet feeding mechanism.

2. Description of the Related Art

Some image forming apparatuses (e.g., copiers, printers, and facsimile machines) are designed to form a sheet conveyance path near a transfer roller so that the sheet conveyance path can be exposed to an outside of the apparatus for easily removing jammed paper(s) remaining near the transfer roller.

For example, Japanese Patent Application Publication Nos. 2011-085815 (JP-2011-085815-A), and 2004-020574 (JP-2004-020574-A) disclose configurations in which an openably retractable transfer cover unit is disposed on an outer surface of an image forming apparatus, and a transfer roller is disposed on an inner surface of the transfer cover unit. Similarly, Japanese Patent Application Publication No. 2000-231321 (JP-2000-231321-A) discloses a configuration in which not only a transfer roller but also one of a pair of timing rollers is disposed on an inner surface of such a transfer cover unit.

The transfer roller and the timing roller can be attached to the transfer cover unit, for example, by attaching respective rotatable axes of the rollers to the transfer cover unit fixedly as disclosed in Japanese Patent Application Publication No. 2000-231321 (JP-2000-231321-A) and swingably as disclosed in Japanese Patent Application Publication Nos. 2011-085815 (JP-2011-085815-A), 2004-020574 (JP-2004-020574-A), and 2006-030643 (JP-2006-030643-A). When the rotatable axes of the rollers are attached to the transfer cover unit fixedly, the transfer cover unit should be correctly positioned at at least four points (top, bottom, left, and right) by a projected and recessed engaging structure (e.g., main body positioning pins 38 and cover recessed portions 37 illustrated in FIG. 3 of JP-2000-231321-A). By contrast, when the rotatable axes of the rollers are attached to the transfer cover unit swingably, the transfer cover unit should have a rotation supporting mechanism (e.g., a receiving member 216, a support shaft member 218, and a compression spring 220 illustrated in FIG. 2 of JP-2011-085815-A).

As disclosed in JP-2011-085815-A, a main body of an image forming apparatus is made compact in size by narrowing a secondary transfer unit and a fixing unit located above the secondary transfer unit (refer to paragraph [0082] of JP-2011-085815-A). Therefore, a transit path of the secondary transfer unit is made different from a transit path of the transfer cover unit to temporarily lower the absolute height of the secondary transfer unit at opening and closing of the transfer cover unit, thereby avoiding interference with the fixing unit. Thereafter, the secondary transfer unit is lifted. (See FIGS. 6 and 9.)

To enable such a transit path, the secondary transfer unit is supported by a rotation supporting mechanism to the transfer cover unit. However, the secondary transfer unit cannot be part of the structure of the transfer cover unit due to the rotation supporting mechanism, and the rigidity of the transfer cover unit decreases. Further, the rotation supporting mechanism as disclosed in JP-2011-085815-A has a high degree of design freedom but a complicated configuration, and therefore a positioning mechanism for positioning the secondary transfer unit having a high degree of design freedom to the main body of the image forming apparatus should be located at at least four positions (top, bottom, left, and right) (a secondary transfer unit guide shaft 228 for a cutout 232 of a main body positioning member 230 and a cutout 238 of a secondary transfer unit positioning member 234 for a main body positioning boss 236 in FIG. 2).

In an image forming apparatus disclosed in JP-2004-020574-A, a linear guide member attached to a main body linearly guides a rotary shaft of a transfer roller attached to a transfer cover unit toward a drive roller attached to the main body. An opening at the leading edge of the linear guide member is located at a slightly lower position, and the transit path of the transfer roller becomes lower in the middle of opening and closing actions of the transfer cover unit but basically aligns with a transit path of the transfer cover unit. That is, the configuration of JP-2004-020574-A is not designed to avoid interference with parts provided in the main body, and therefore provides relatively less design freedom of space for a compact layout of the parts of the main body without interference with the transit path of the transfer roller.

In an image forming apparatus disclosed in JP-2000-231321-A, both the transfer roller and the timing roller can be exposed by opening the transfer cover unit, which can remove jammed paper in a vicinity of the rollers easily. Further, since the respective rotary shafts of the transfer roller and the pair or timing rollers are fixedly attached to the transfer cover unit, the above-described rotation supporting mechanism is not required. However, these transit paths of the rollers basically match the transit path of the transfer cover unit, and therefore the configuration of JP-2000-231321-A provides relatively less design freedom of space for a compact layout of the parts of the main body without interference with the transit path of the transfer roller.

Also in an image forming apparatus disclosed in JP-2006-030643-A, the transit paths of the transfer roller and the timing roller are basically the same as the transit paths of the transfer cover unit, and therefore the same issue regarding the interference with the parts of the main body (e.g., a photoconductive drums and an intermediate transfer belt) might arise when a compact layout of the image forming apparatus is attempted. Further, the mechanism of the image forming apparatus can be complicated due to arrangement of a transfer guide member and an operation lever to the transfer cover unit, which also leads to another issue regarding accuracy in positioning of the rotary shafts of the transfer roller and the timing roller.

Similar to JP-2011-085815-A, when a transfer roller and a timing roller are swingably disposed on the inner surface of the transfer cover unit, a simple mechanism or configuration to position the transfer roller and the timing roller with a drive roller and a timing roller provided in the main body is required.

SUMMARY OF THE INVENTION

The present invention describes a novel sheet feeding mechanism which includes a cover unit, a first feeding member, a second feeding member, and the guide member. The cover unit is rotatably attached to one side of a main body of an image forming apparatus to cover a part of a sheet conveyance path. The first feeding member is located in the main body of the image forming apparatus. The second feeding member is located in the cover unit in a displaceable manner and facing the first feeding member when the cover unit is closed. The first feeding member and the second feeding member sandwich and convey a recording medium along the sheet conveyance path. The guide member is disposed in the main body to guide the second feeding member. The guide member guides the second feeding member to move in a first direction that approaches the first feeding member when closing the cover unit and in a second direction that separates from the first feeding member when opening the cover unit.

The above-described sheet feeding mechanism may further include a rotary arm to support the second feeding member. The second feeding member may move in the first direction according to cooperation of the rotary arm and the guide member while the cover unit is closing, and in the second direction according to cooperation of the rotary arm and the guide member while the cover unit is opening.

The second feed member may be biased in the first direction by an elastic member while the second feeding member is guided by the guide member.

The second feeding member may be supported at a leading edge of the rotary arm, and a base end of the rotary arm may be supported by the cover unit to be rotatable in the first direction and in the second direction.

A regulated portion may be formed on a side surface of the rotary arm to contact a regulating member formed on the cover unit in a width direction of the second feeding member.

One of the regulated portion and the regulating member may include a slope to reduce play between the regulated portion and the regulating member.

A regulated member of the rotary arm and a supporting portion of the displaceable second feeding member at the leading edge of the rotary arm may be disposed offset in the width direction of the second feeding member.

A pressure lever may be disposed between the elastic member and the rotary arm. A biasing force of the elastic member may be exerted in the first direction via the pressure lever and the rotary arm.

The biasing force of the pressure lever with respect to the rotary arm may be released in a non-guided state in which the second feeding member is not guided by the guide member.

The pressure lever may be rotatably supported by a pivot formed on the cover unit. The regulating member of the cover unit may be formed by a leading edge of the pivot.

Since the displaceable second feeding member is in the non-guide state, the rotary arm may contact a stopper surface mounted on the cover unit to regulate the position thereof.

The above-described sheet feeding mechanism may further include a sheet feed guide disposed upstream from the second feeding member in the sheet conveyance direction. A downstream end of the sheet feed guide may be engaged with the second feeding member.

A transit path of the cover unit may be one of a straight line and an arc.

The above-described sheet feeding mechanism may further include a third sheet feeding member located in the main body and downstream from the first sheet feeding member in the sheet conveyance direction, and a fourth sheet feeding member located in the cover unit in a displaceable manner, downstream from the second sheet feeding member in the sheet conveyance direction, and facing the third feeding member when the cover unit is closed. The third feeding member and the fourth feeding member may sandwich and convey the recording medium along the sheet conveyance path. By moving in the second direction when opening or closing the cover unit, the second feeding member avoids interference with the third feeding member.

Further, the present invention describes a novel image forming apparatus including a writing device to optically write image data, an image forming device to form an image based on the image data written by the writing device, a transfer unit to transfer the image formed in the image forming device onto a recording medium, a fixing unit to fix the image to the recording medium, a sheet conveyance path through which the image-fixed recording medium travels from the transfer unit via the fixing unit to a sheet discharging unit, and the above-described sheet feeding mechanism disposed on the sheet conveyance path.

The first feeding member and the second feeding member may be a pair of timing rollers and the third feeding member and the fourth feeding member may be a pair of transfer rollers.

The cover may include a duplex unit therein.

The above-described image forming apparatus may be a multi-functional apparatus having two or more functions of a copier, a printer, and a facsimile machine.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
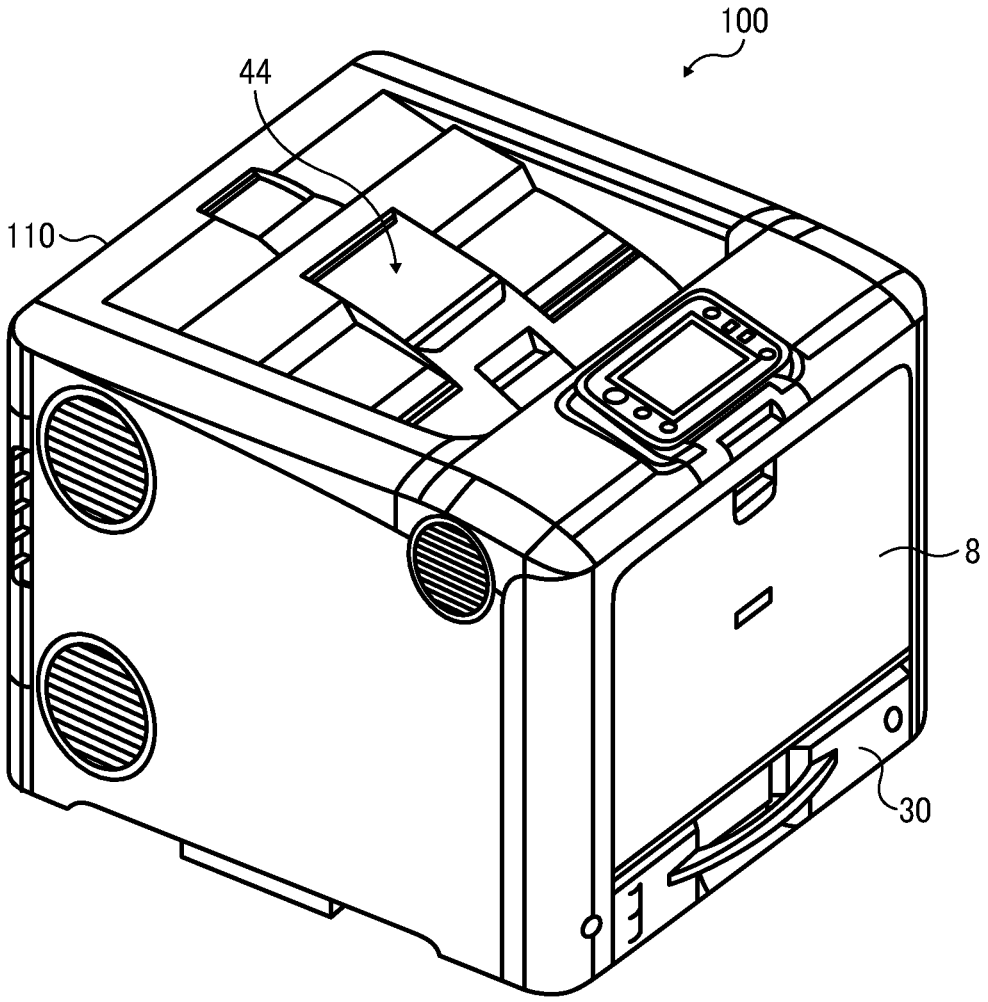
FIG. 1 is a perspective view of an image forming apparatus according to an exemplary embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, preferred embodiments of the present invention are described.

A description is given of an exemplary embodiment applicable to a sheet feeding mechanism and an electrophotographic image forming apparatus.

It is to be noted in the present invention that: the term "image forming apparatus" indicates an apparatus in which an image is formed on a medium such as paper, thread, fiber, fabric, leather, metal, plastic, glass, wood, and/or ceramic by attracting developer or ink thereto; the term "image formation" indicates an action for providing (i.e., printing) not only an image having meanings such as texts and figures on a recordable medium but also an image having no meaning such as patterns on a medium on a medium; and the term "sheet" is not limited to indicate a paper material but also includes the above-described plastic material (e.g., an OHP sheet), a fabric sheet and so forth, and is used as a general term of a recorded medium, recording medium, recording sheet, and recording material to which the developer or ink is attracted.

[Image Forming Apparatus]

Referring to FIGS. 1 through 4, a description is given of a configuration of an image forming apparatus 100.

FIG. 1 is a perspective view illustrating an appearance of the image forming apparatus 100 according to an exemplary embodiment of the present invention. In an exemplary embodiment described with FIGS. 1 through 4, the image forming apparatus 100 is a laser printer. Alternatively, the image forming apparatus 100 may be a copier, printer, facsimile machine, or a multifunctional machine having at least two functions of the copier, printer, and facsimile machine, and can incorporate to a sheet feeding mechanism 120 (see FIGS. 5A, 5B, and 12A-12C) according to the exemplary embodiment of the present invention.

Referring to FIG. 1, the image forming apparatus 100 includes a main body 110, a sheet feeding tray 30, a transfer cover unit 8, and a sheet discharging tray 44.

The main body 110 includes a plurality of units and components used for image formation. Details of the units and components will be described later.

The sheet feeding tray 30 is disposed at the lower part of the image forming apparatus 100.

The transfer cover unit 8 is disposed above the sheet feeding tray 30 and on the outside surface of the image forming apparatus 100 to serve as a cover for opening and closing when checking the inside of the image forming apparatus 100.

The sheet discharging tray 44 is formed at the upper portion of the image forming apparatus 100.

Figure 2:
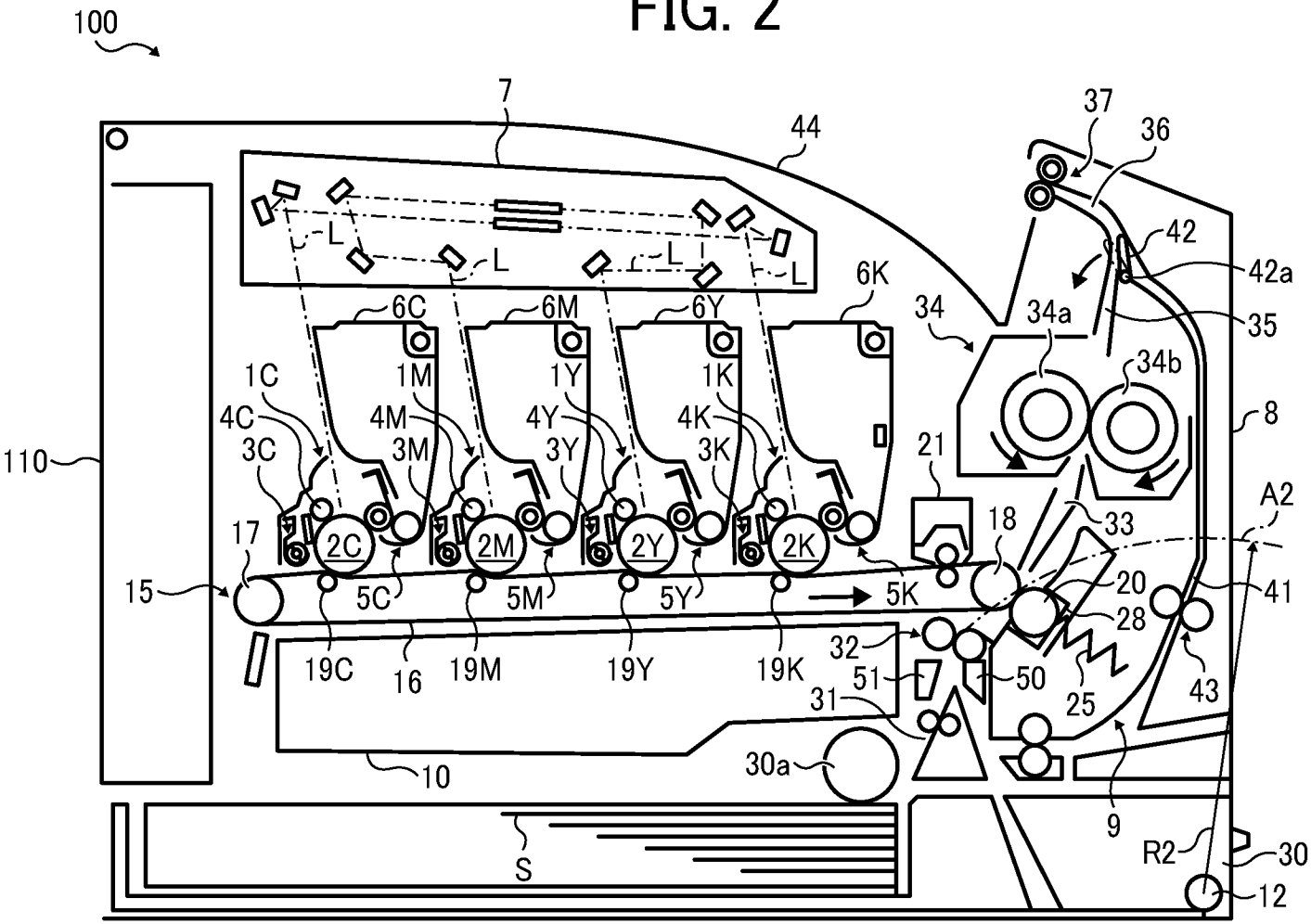
FIG. 2 is a cross-sectional view illustrating an inner structure of the image forming apparatus according to an exemplary embodiment of the present invention.

Referring to FIG. 2, a main part of the image forming apparatus 100 is described.

Figure 3:
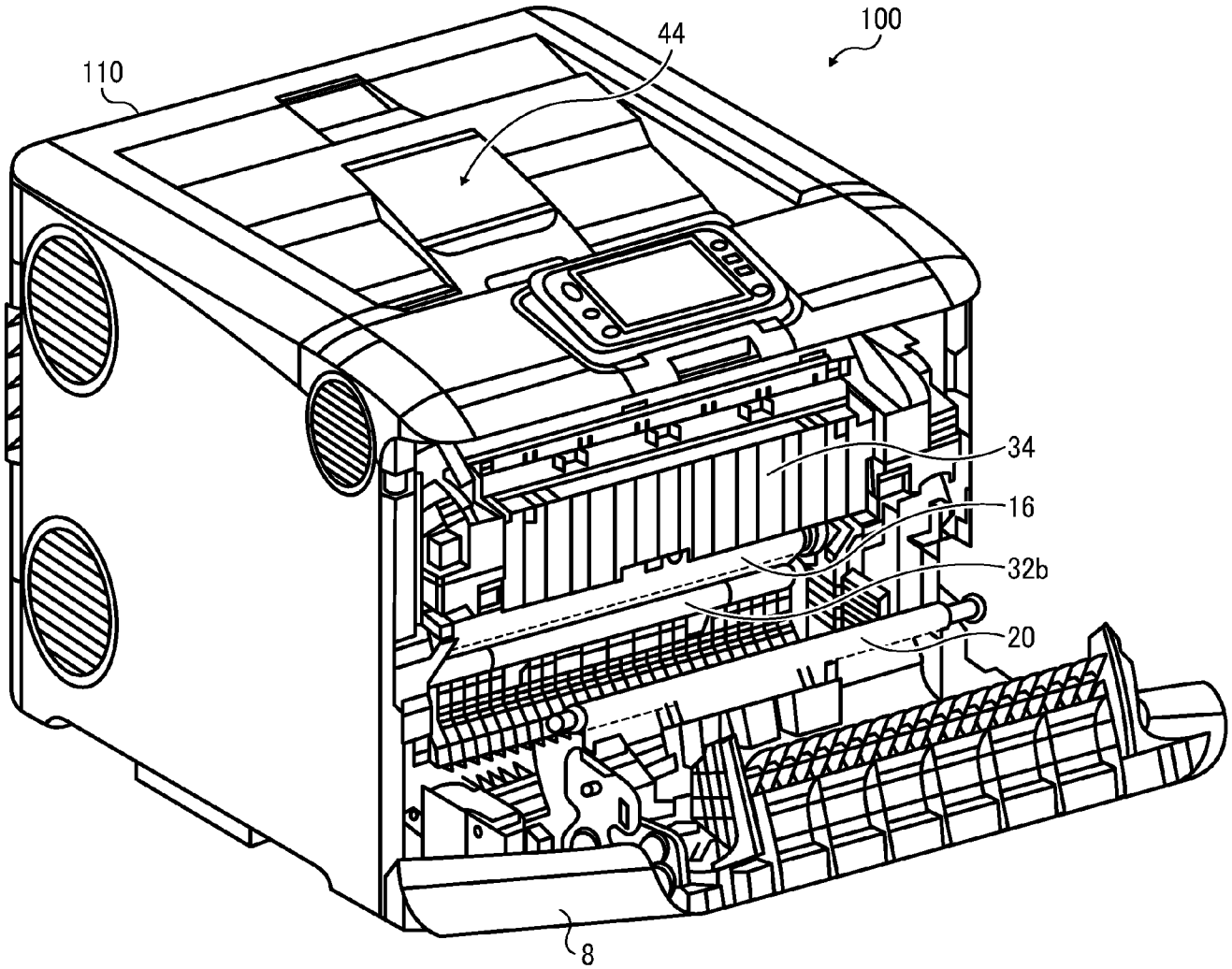
FIG. 3 is a perspective view illustrating a state in which a transfer cover unit of the image forming apparatus is open according to an exemplary embodiment of the present invention.
Figure 4:
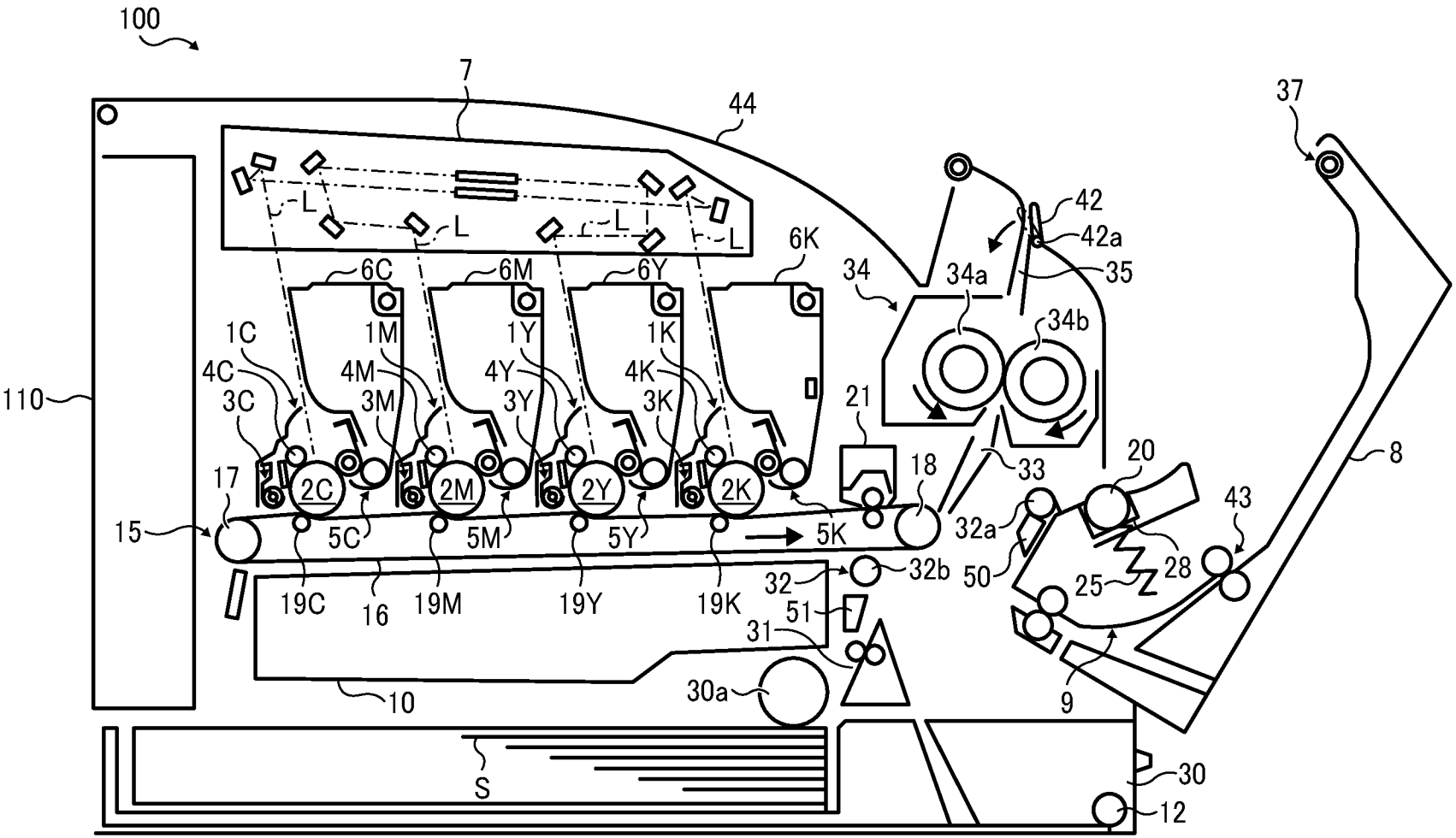
FIG. 4 is a cross-sectional view illustrating a state in which the transfer cover unit of the image forming apparatus is open according to an exemplary embodiment of the present invention.

The transfer cover unit 8 includes a duplex unit 9 on the inner surface thereof and, as illustrated in FIGS. 2 and 4, rotates about a rotary shaft 12 disposed at the lower part of the image forming apparatus 100 to open toward the front side of the image forming apparatus 100, as illustrated in FIG. 3.

The duplex unit 9 includes a conveyance housing 9*a* (see FIG. 5), and a sheet switch-back path 9*b* is formed on the backside of the conveyance housing 9*a*. The inner surface thereof forms a part of a sheet conveyance path of the main body 110 of the image forming apparatus 100. Further, the conveyance housing 9*a* includes a secondary transfer roller 20 that serves as a transfer member and a timing drive roller 32*a* that is one of a pair of timing rollers 32. The secondary transfer roller 20 composes a pair of transfer rollers serving as a pair of feeding members together with a drive roller 18 disposed in the main body 110 of the image forming apparatus 100. Together with a timing driven roller 32*b* disposed in the main body 110 of the image forming apparatus 100, the timing drive roller 32*a* composes the pair of timing rollers 32 serving as a pair of feeding members.

As illustrated in FIG. 2, the main body 110 of the image forming apparatus 100 includes four process units 1K, 1Y, 1M, and 1C that serve as image forming units for forming images according to respective single color developers (i.e., black, yellow, magenta, and cyan) corresponding to color separation of a color image.

The process units 1K, 1Y, 1M, and 1C are disposed in the main body 110 of the image forming apparatus 100, and have respective toner bottles 6K, 6Y, 6M, and 6C for containing unused toners of colors different from each other. The process units 1K, 1Y, 1M, and 1C have the same structure, differing only in the colors of toners in the toner bottles 6K, 6Y, 6M, and 6C.

The process units 1K, 1Y, 1M, and 1C further include photoconductor drums 2K, 2Y, 2M, and 2C serving as image carriers, drum cleaning units 3K, 3Y, 3M, and 3C, non-illustrated electricity discharging units, charging units 4K, 4Y, 4M, and 4C, and developing units 5K, 5Y, 5M, and 5C, respectively. The process units 1K, 1Y, 1M, and 1C are detachably attachable to the main body 110 of the image forming apparatus 100, and consumable parts can be replaced at one time.

The main body 110 further includes an optical writing device 7, a transfer device 15, a fixing unit 34, and a powder container 10.

The optical writing device 7 is disposed above the process units 1K, 1Y, 1M, and 1C and is configured to emit laser light beams L from laser diodes therein based on image data.

The transfer device 15 is disposed below the process units 1K, 1Y, 1M, and 1C, and includes four primary transfer rollers 19K, 19Y, 19M, and 19C, an intermediate transfer belt 16, the secondary transfer roller 20, a belt cleaning unit 21, and a cleaning backup roller 22.

The primary transfer rollers 19K, 19Y, 19M, and 19C are disposed facing the photoconductor drums 2K, 2Y, 2M, and 2C, respectively. The intermediate transfer belt 16 is an endless belt that is spanned over the primary transfer rollers 19K, 19Y, 19M, and 19C, the drive roller 18, and a driven roller 17. The secondary transfer roller 20 that serves as a secondary transfer unit is disposed facing the drive roller 18 to form the pair of transfer rollers. The photoconductor drums 2K, 2Y, 2M, and 2C are defined as first image carriers, and the intermediate transfer belt 16 may be a second image carrier that carries a composite image thereon.

As described above, the sheet feeding tray 30 that can contain multiple sheets including a sheet S is disposed at the lower part of the image forming apparatus 100. Further, a sheet feeding roller 30*a* is also disposed to feed the sheet S from the sheet feeding tray 30 toward a sheet feeding path 31. Around the downstream end of the sheet feeding path 31 and immediately upstream from the intermediate transfer belt 16, the pair of timing rollers 32 is disposed to stop the sheet S there temporarily. To cause a toner image formed on the intermediate transfer belt 16 to meet the leading edge of the sheet S at a proper position, the sheet S is sagged at the pair of timing rollers 32 once, and is then fed to a secondary transfer nip portion at a predetermined timing immediately before a toner image formed on the intermediate transfer belt 16 is transferred onto the sheet S at the secondary transfer nip portion.

The secondary transfer roller 20 is generally tensioned by a compression spring 25 to the intermediate transfer belt 16. However, in the image forming apparatus 100 of a full-front access type, the duplex unit 9 is generally disposed before the intermediate transfer belt 16 and closer to the front cover, which makes it difficult to reduce the size of the area around the compression spring 25. Therefore, a transfer nip portion is arranged in an oblique direction, as illustrated in FIG. 2, so that dead space in the duplex unit 9 can be used effectively, thereby achieving a reduction in space in a front-to-back direction of the image forming apparatus 100.

A post-transfer sheet conveyance path 33 is disposed above the transfer nip portion formed between the secondary transfer roller 20 and the drive roller 18.

The fixing unit 34 is disposed in the vicinity of one end of the post-transfer sheet conveyance path 33, and includes a fixing roller 34*a* and a pressure roller 34*b*. The fixing roller 34*a* includes a heating source such as a non-illustrated halogen lamp, and the pressure roller 34*b* rotates while contacting the fixing roller 34*a* with a given pressure.

A post-fixing sheet conveyance path 35 is defined above the fixing unit 34 and branches into two paths, which are a sheet discharging path 36 and a switch-back conveyance path 41. A switching member 42 is disposed at the downstream end of the post-fixing sheet conveyance path 35, and rotates about a swing shaft 42*a* for switching the direction of the sheet S. A pair of sheet discharging rollers 37 is disposed at the downstream end of the sheet discharging path 36. The switch-back conveyance path 41 meets a sheet feeding path 31 at the downstream end thereof. A pair of switch-back conveyance rollers 43 is disposed in the middle of the switch-back conveyance path 41. Further, the sheet discharging tray 44 is formed on top of the main body 110 of the image forming apparatus 100, with a top cover thereof recessed inwardly.

The powder container (that is, the tray container) 10 is disposed between the transfer device 15 and the sheet feeding tray 30 to contain waste toner therein. The powder container 10 is detachably attachable to the main body 110 of the image forming apparatus 100.

In the image forming apparatus 100 according to this exemplary embodiment of the present invention, it is necessary to separate the sheet feeding roller 30*a* from the secondary transfer roller 20 by a certain distance or gap due to conveyance of a transfer sheet such as the sheet S. This separation generates dead space or unused space, which can be used to dispose the powder container 10 therein, resulting in achieving a reduction in overall size of the image forming apparatus 100.

[Operations Performed by the Image Forming Apparatus]

Next, a description is given of basic operations of the image forming apparatus 100 according to an exemplary embodiment of the present invention.

As shown in FIG. 1, a non-illustrated controller of the image forming apparatus 100 issues sheet feeding signals to rotate the sheet feeding roller 30*a*. As the sheet feeding roller 30*a* starts to rotate, the sheet S placed on top of a stack of sheets in the sheet feeding tray 30 is separated from the other sheets accommodated in the sheet feeding tray 30 and is fed toward the sheet feeding path 31. When the leading edge of the sheet S reaches the nip portion of the pair of timing rollers 32, the sheet S stands by while being sagged to calibrate skew at the leading edge of the sheet S to synchronize with movement of a toner image formed on the intermediate transfer belt 16.

For example, in basic image forming operations of the process unit 1K, the charging unit 4K uniformly charges a surface of the photoconductor drum 2K by supplying a high electric potential at the surface of the photoconductor drum 2K. Based on image data, the laser light beam L is emitted from the optical writing device 7 to the charged surface of the photoconductor drum 2K so that the electric potential at the emitted portion on the surface of the photoconductor drum 2K decreases to form an electrostatic latent image. The toner bottle 6K supplies the unused black toner to the developing unit 5K.

The developing unit 5K supplies the black toner to the electrostatic latent image formed on the surface of the photoconductor drum 2K to develop the electrostatic latent image into a visible black toner image. Then, the toner image formed on the surface of the photoconductor drum 2K is transferred onto a surface of the intermediate transfer belt 16.

The drum cleaning unit 3K removes residual toner remaining on the surface of the photoconductor drum 2K after an intermediate transfer operation. The removed residual toner is conveyed by a non-illustrated waste toner conveyance unit and collected to a waste toner collecting unit included in the process unit 1K. Further, the electricity discharging unit removes residual electric potential remaining on the surface of the photoconductor drum 2K after cleaning.

Even though the above description details operations in the process unit 1K, the same operation is performed in the other process units 1Y, 1M, and 1C. For example, respective toner images are developed on the respective surfaces of the photoconductor drums 2Y, 2M, and 2C and are then sequentially transferred onto the surface of the intermediate transfer belt 16 to form a composite color image.

After the respective color toner images are transferred sequentially onto the surface of the intermediate transfer belt 16 to form a composite toner image, the pair of timing rollers 32 and the sheet feeding roller 30*a* start driving to convey the sheet S to the secondary transfer roller 20 in synchronization with movement of the toner image formed on the surface of the intermediate transfer belt 16. Then, the composite toner image formed on the surface of the intermediate transfer belt 16 is transferred onto the sheet S conveyed as above at the secondary transfer nip portion formed between the intermediate transfer belt 16 and the secondary transfer roller 20.

The sheet S on which the transferred toner image is formed passes through the post-transfer sheet conveyance path 33 to the fixing unit 34. The sheet S in the fixing unit 34 is sandwiched by the fixing roller 34*a* and the pressure roller 34*b* and the unfixed toner image on the sheet S is fixed to the sheet S by application of heat and pressure. The sheet S with the fixed image thereon is conveyed from the fixing unit 34 to the post-fixing sheet conveyance path 35.

At the feeding of the sheet S from the fixing unit 34, the switching member 42 is at a position as illustrated by a solid line in FIG. 2 to allow passage of the sheet S around the end of the post-fixing sheet conveyance path 35. Then, the sheet S conveyed from the fixing unit 34 travels through the post-fixing sheet conveyance path 35, is sandwiched by the pair of sheet discharging rollers 37, and then comes to be discharged to the sheet discharging tray 44.

When performing a duplex printing, as the trailing edge of the sheet S conveyed by the pair of sheet discharging rollers 37 passes through the post-fixing sheet conveyance path 35, the switching member 42 rotates to a position indicated by a dotted line in FIG. 2 to block the passage of the sheet S at the end of the post-fixing sheet conveyance path 35. Substantially simultaneously, the pair of sheet discharging rollers 37 rotates in reverse to feed the sheet S in an opposite direction to the switch-back conveyance path 41.

The sheet S conveyed in the switch-back conveyance path 41 passes through the pair of switch-back conveyance rollers 43 and reaches the pair of timing rollers 32. The sheet S is fed in synchronization with another toner image formed on the surface of the intermediate transfer roller 16 for printing the toner image on a reverse side of the sheet S. When the sheet S passes through the secondary transfer nip portion formed between the drive roller 18 and the secondary transfer roller 20 with the intermediate transfer belt 16 therebetween, the toner image is formed on the rear side of the sheet S. Then, after the toner image formed on the rear side of the sheet S is fixed by the fixing unit 34 to the sheet S, the sheet S travels through the post-fixing sheet conveyance path 35, the sheet discharging path 36, and the pair of sheet feeding rollers 37 to be discharged to the sheet discharging tray 44.

Further, even after the toner image formed on the surface of the intermediate transfer belt 16 has been transferred onto the sheet S, residual toner remains on the surface of the intermediate transfer belt 16. Such residual toner is removed by the belt cleaning unit 21 from the intermediate transfer belt 16.

The residual toner removed from the intermediate transfer belt 16 is conveyed by a non-illustrated waste toner conveyance unit to the powder container 10 and collected through an entrance 53 of the powder container 10, as shown in FIG. 2.

[Transfer Cover Unit]

If a paper jam occurs in the middle of a printing job, a user can open the transfer cover unit 8 manually by rotating the transfer cover unit 8 about the rotary shaft 12 to the outside, as illustrated in FIGS. 3 and 4, so that a jammed paper or papers stuck inside the image forming apparatus 100 can be removed. If the sheet S remains sandwiched by the pair of timing rollers 32, the pair of timing rollers 32 exerts a very high pressure, and therefore it is likely difficult to remove the jammed paper from the pair of timing rollers 32 that are closely contacted to each other.

In this exemplary embodiment, since the transfer roller 20 and the timing drive roller 32*a* that is one of the pair of timing rollers 32 are disposed inside the transfer cover unit 8, once the transfer cover unit 8 is opened, the transfer roller 20 and the pair of timing rollers 32 can be released to open, thereby enabling removal of the jammed paper(s) quickly and easily. That is, as illustrated in FIGS. 3 and 4, by opening the transfer cover unit 8 by rotating it about the rotary shaft 12 toward the front side of the image forming apparatus 100, the fixing unit 34, one end of the intermediate transfer belt 16 and the timing driven roller 32*b* disposed inside the image forming apparatus 100 are exposed, thereby facilitating paper jam removal.

[Secondary Transfer Roller]

Figure 12A:
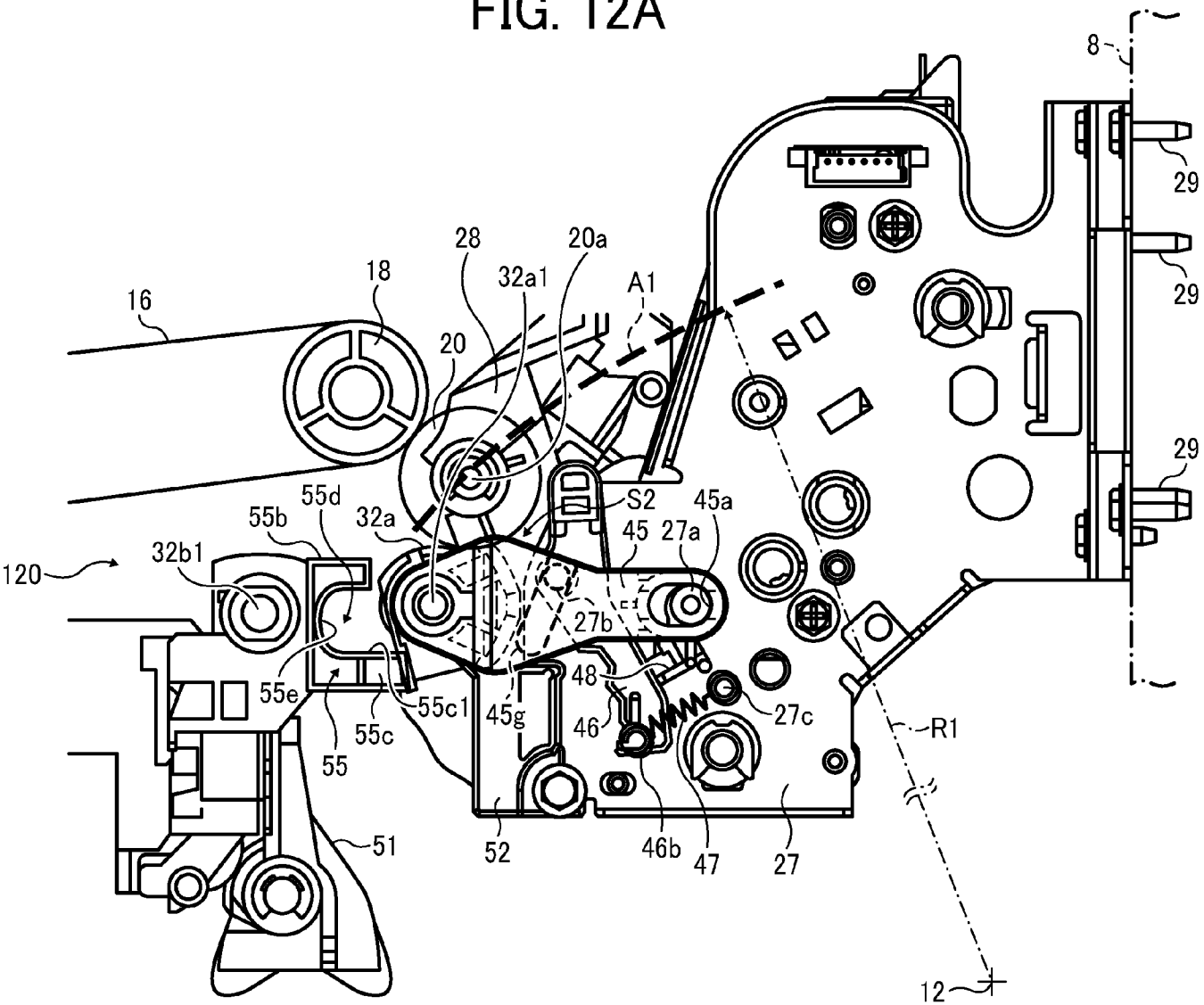
FIG. 12A is a side view illustrating a first step of a final stage for closing the transfer cover unit, indicating a state immediately before the rotary shaft of the timing drive roller is guided to the positioning guide member.
Figure 12B:
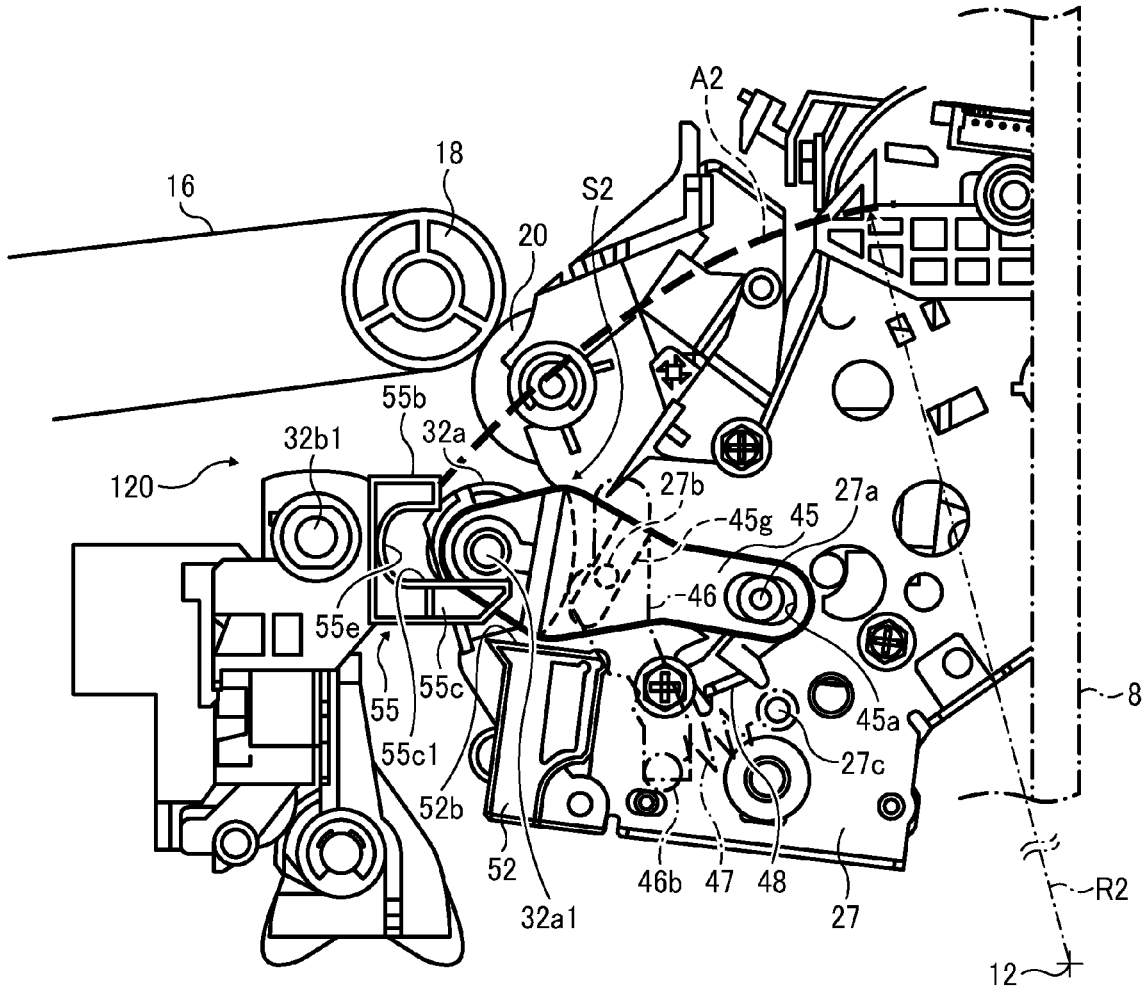
FIG. 12B is a side view illustrating a second step of the final stage for closing the transfer cover unit, indicating a state in which the rotary shaft of the timing drive roller is being guided to the positioning guide member.
Figure 12C:
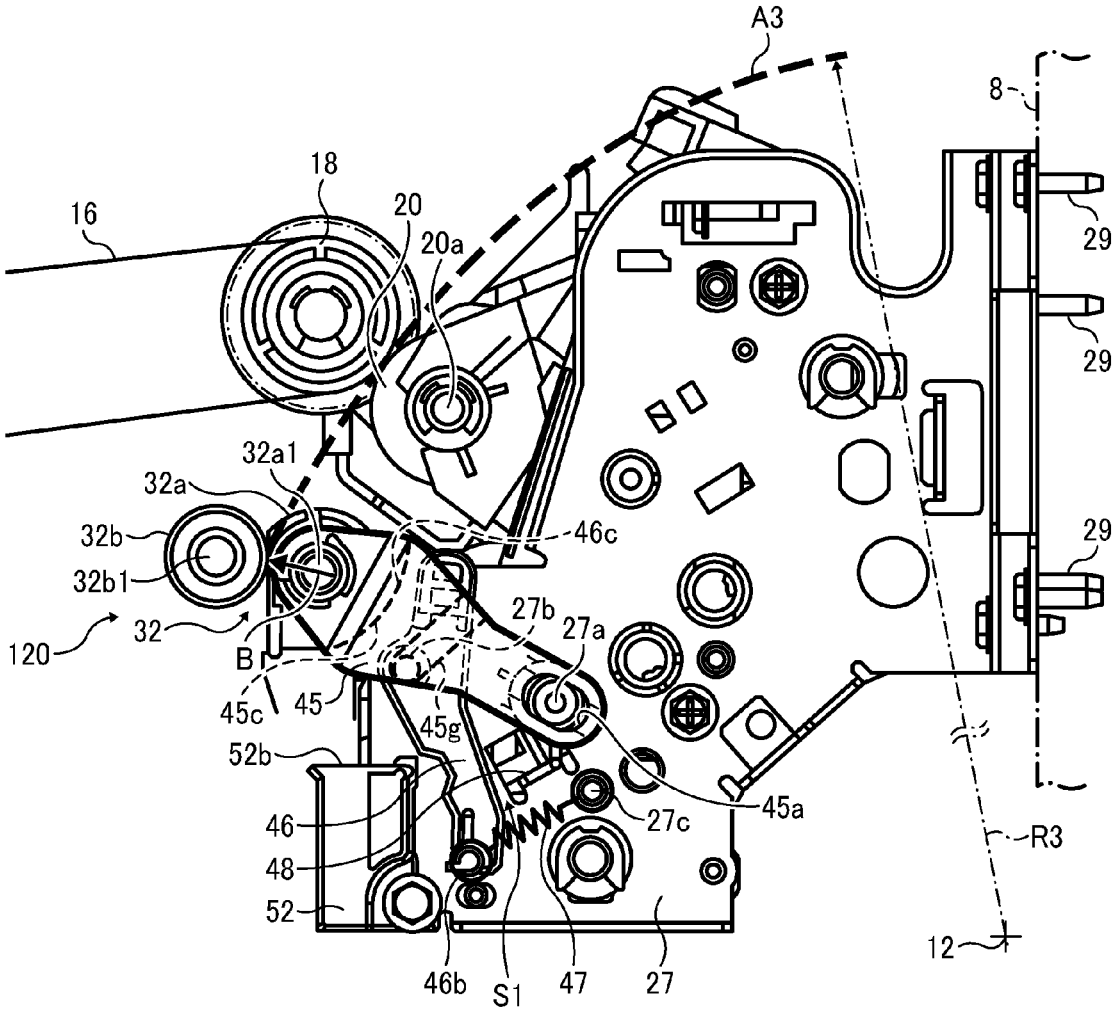
FIG. 12C is a side view illustrating a third step of the final stage for closing the transfer cover unit, indicating a state in which the timing drive roller contacts the timing driven roller.

As illustrated in FIGS. 12A through 12C, the secondary transfer roller 20 is disposed on the inside surface of the transfer cover unit 8. On the inside surface cover of the transfer cover unit 8, a pair of end plates 27 are fixed to both left and right side of the transfer cover unit 8 by multiple screws 29. By so doing, units such as the secondary transfer roller 20 and the timing drive rollers 32*a* attached to the pair of end plates 27 reinforce the transfer cover unit 8. A support plate 28 is disposed on the inside surface of the pair of end plates 27, and a rotary shaft 20*a* of the secondary transfer roller 20 is rotatably attached to the support plate 28. As illustrated in FIG. 2, the support plate 28 is biased by the compression spring 25 toward the drive roller 18.

[Timing Drive Roller]

Figure 5A:
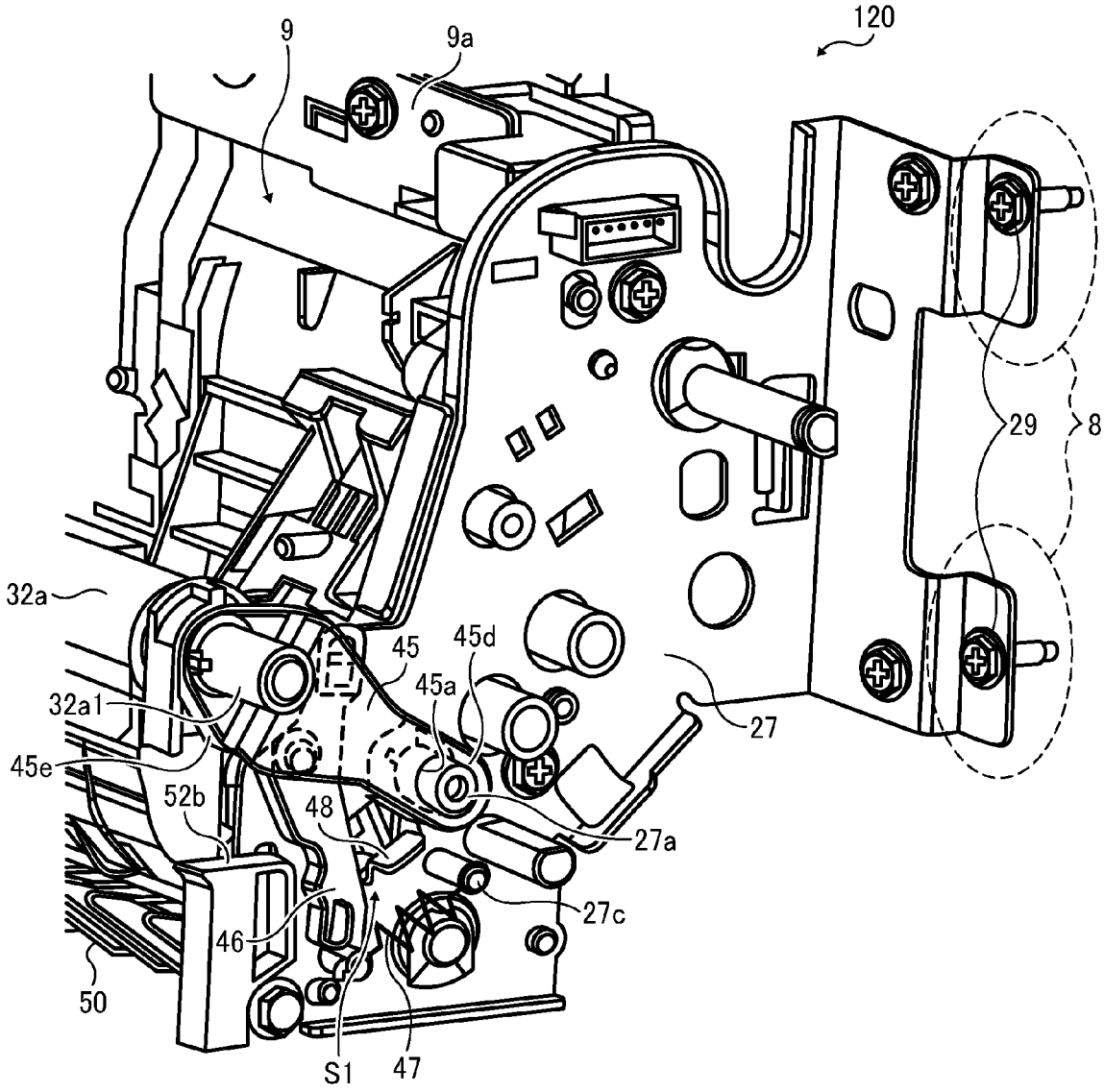
FIG. 5A is a perspective view illustrating an inside of the transfer cover unit, which corresponds to a sheet feeding mechanism, when the transfer cover unit is closed.
Figure 5B:
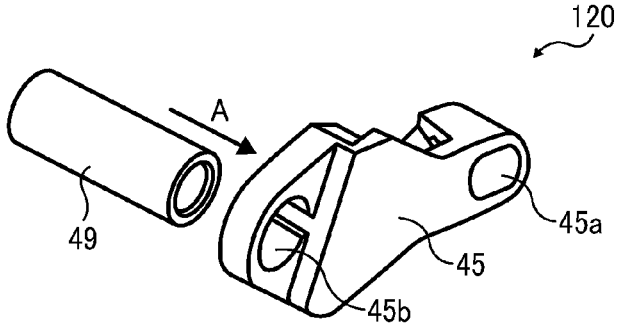
FIG. 5B is a perspective view illustrating a modification of a bearing of a timing drive roller in the sheet feeding mechanism.

As illustrated in FIG. 5A, both ends of a rotary shaft 32*a*1 of the timing drive roller 32*a* provided on the inside surface of the transfer cover unit 8 are supported in a direction slightly outwardly projecting with respect to a rotary arm 45. This rotary arm 45 includes a slot 45*a* formed on a base end 45*d* thereof, and a cylindrical pivot 27*a* of the pair of end plates 27 disposed at both ends of the conveyance housing 9*a* is rotatably inserted into the slot 45*a*. Accordingly, the rotary arm 45 is rotatable about the pivot 27*a* and slidably movable along the slot 45*a*. Further, one end of the rotary shaft 32*a*1 of the timing drive roller 32*a* is rotatably inserted into a shaft hole 45*b* formed on a supporting portion 45*e* at the leading edge of the rotary arm 45. The timing drive roller 32*a* is configured to rotate in a sheet conveyance direction by a non-illustrated rotary drive mechanism.

It is to be noted that, since the inner circumferential surface of the shaft hole 45*b* of the rotary arm 45 directly contacts the rotary shaft 32*a*1 of the timing drive roller 32*a*, it is preferable that the rotary arm 45 is made of a material with which the rotary arm 45 and the rotary shaft 32*a*1 slide well. Further, to reduce the number of parts by using common shaped parts for the left and right side of the rotary arm 45 and to achieve good assembly of the parts, it is preferable that the rotary arm 45 has a symmetrical design on both the front and rear sides.

Further, since a high pressure is exerted at both ends of the rotary shaft 32*a*1 of the timing drive roller 32*a* due to the nip pressure exerted at the pair of timing rollers 32, the shaft hole 45*b* of the rotary arm 45 may be worn out easily by friction with the rotary shaft 32*a*1, resulting in a shorter life of the shaft hole 45*b*. Therefore, to increase durability of the shaft hole 45*b*, an inner diameter of the shaft hole 45*b* may be formed slightly larger than the diameter of the rotary shaft 32*a*1 of the timing drive roller 32*a* to allow a tubular bearing 49 formed by metal or resin having high wear resistance or other high performance material to be pressure caulked or fixed by glue in the shaft hole 45*b* in a direction indicated by arrow A in FIG. 5B. With this configuration, an amount of expensive material can be reduced and a longer life of a bearing can be achieved at low cost.

As illustrated in FIG. 6, a pressure lever 46 is disposed between the rotary arm 45 and the end plate 27. The pressure lever 46 includes a shaft hole 46*a* at a middle portion in a longitudinal direction thereof, and the pivot 27*b* formed on the end plate 27 is inserted into the shaft hole 46*a*. The pressure lever 46 rotates about the pivot 27*b*.

As illustrated in FIGS. 12A through 12C, one end of a tension spring 47 that serves as an elastic member is connected to a hook 46*b* at the lower end of the pressure lever 46. The other end of the tension spring 47 is latched onto the shaft 27*c* of the end plate 27. The pressure lever 46 is constantly biased by the tension spring 47 to rotate about the pivot 27*b* in a counterclockwise direction in FIGS. 12A through 12C.

A flat pressure surface 46*c* is formed on a side surface at the leading edge of the pressure lever 46, and contacts a pressed surface 45*c* that is formed around the shaft hole 45*b* of the rotary shaft 45 due to the force exerted by the tension spring 47, as illustrated in FIGS. 6 and 12C. In the state illustrated in FIG. 12C, the pressed surface 45*c* includes a surface substantially perpendicular to a straight line connecting the rotary shaft 32*a*1 of the timing drive roller 32*a* and a rotary shaft 32*b*1 of the timing drive roller 32*b*.

With this configuration, the force exerted by the tension spring 47 is transmitted to the timing drive roller 32*a* effectively, and therefore, even with a small spring, a sufficient timing roller nip pressure can be generated. Since the flat pressure surface 46*c* of the pressure lever 46 presses the pressed surface 45*c* of the pressure lever 45, the rotary arm 45 is constantly biased in a linear manner in an axial direction of the rotary shaft 32*b*1 of the timing driven roller 32*b*, as indicated by arrow B in FIG. 12C, in a state in which the transfer cover unit 8 is closed. It is preferable that the rim of the shaft hole 45*b* be provided with a tapered surface 45*h*, if necessary, so that the rotary shaft 32*a*1 can be inserted thereinto smoothly.

The slot 45*a* of the rotary arm 45 enables the rotary arm 45 to move in a direction indicated by the arrow B in FIG. 12C by the force exerted by the tension spring 47. It is to be noted that the type of spring to bias the rotary arm 45 is not limited to the tension spring 47. Instead of the pressure lever 46 and the tension spring 47, a torsion spring may be disposed around the pivot 27*a* to bias the pivot 27*a* in a counterclockwise direction and a compression spring may be disposed to the left side of the pivot 27*a* in the slot 45*a* to bias the rotary arm 45 outwardly, which can obtain a similar biasing effect.

A space between the base end 45*d* and the supporting portion 45*e* of the rotary arm 45 is defined as a planar middle portion 45*f*, and a base end 45*d* and a supporting portion 45*e* are disposed on one side of the plate-shaped middle portion 45*f* (i.e., inside of an axial direction of the timing drive roller 32*a*). That is, the base end 45*d* and the supporting portion 45*e* are disposed offset in a width direction of the timing drive roller 32*a*, that is, in an axial direction to the middle portion 45*f*.

Figure 6A:
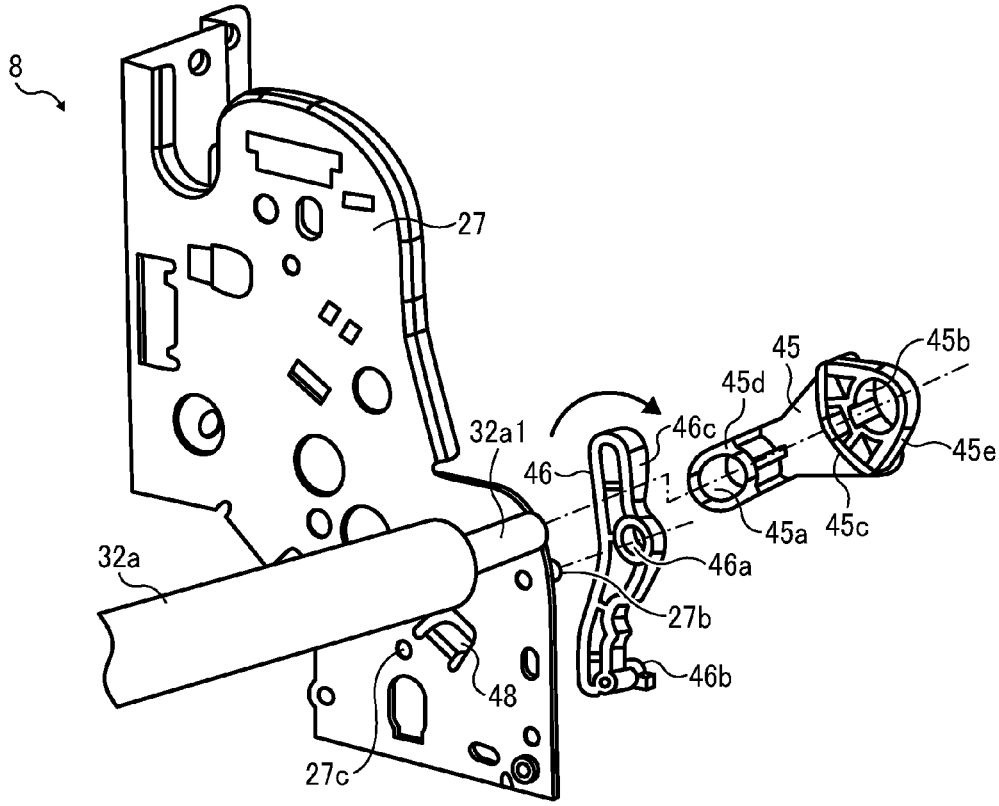
FIG. 6A is an exploded perspective view illustrating a mounting structure of the timing drive roller having a rotary shaft.
Figure 6B:
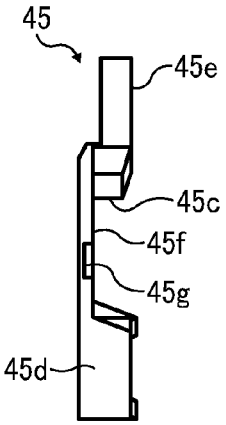
FIG. 6B is a front view of a modification of a rotary arm.

Accordingly, there is a space inside the middle portion 45*f*, as illustrated in FIG. 6B. The space can be used to locate parts such as the pressure lever 46 without interfering with the rotary arm 45, and can achieve a reduction in space in the image forming apparatus 100. Since multiple drive parts can be located in the vicinity of both ends of the timing drive roller 32*a*, such a reduction in space is effective for achieving a compact configuration of the image forming apparatus 100.

It is to be noted that, depending on the layout of parts provided to the transfer cover unit 8, the space can be provided on the opposite side of the middle portion 45*f* (i.e., outside the axial direction of the timing drive roller 32*a*). Also in this case, the space can be used to locate the other parts to be located on the transfer cover unit 8 without interfering with the rotary arm 45, and therefore the size of the image forming apparatus 100 can be reduced.

Figure 6C:
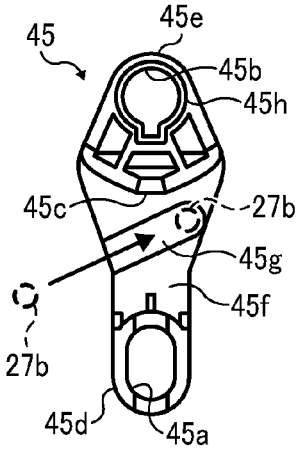
FIG. 6C is a side view of the rotary arm.
Figure 6D:
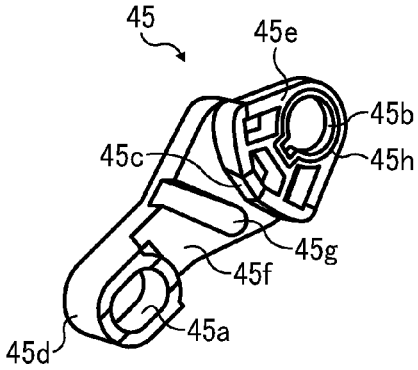
FIG. 6D is a perspective view illustrating of the rotary arm.

On the middle portion 45*f* of the rotary arm 45, a regulated portion 45*g* can be provided if necessary, as illustrated in FIGS. 6B through 6D. The regulated portion 45*g* is configured to contact a regulating portion formed on the transfer cover unit 8 (i.e., the leading edge of the pivot 27*b* of the pressure lever 46 in this exemplary embodiment). The regulating portion can be formed with a member other than the leading edge of the pivot 27*b* or can be a projecting portion formed on the end plate 27 in the vicinity of the pivot 27*b*. By forming the regulating portion with the leading edge of the pivot 27*b*, the form of the end plate 27 can be simpler so that the size of the image forming apparatus 100 can be reduced and the degree of design freedom in the location of parts on the end plate 27 can be increased.

Specifically, as described above, the rotary arm 45 has the pivot 27*a* inserted into the slot 45*a* and is supported rotatably about the pivot 27*a* and slidably moved to the slot 45*a*. Therefore, the rotary arm 45 can easily have looseness due to a play between the pivot 27*a* and the slot 45*a*. If the amount of looseness is rather large, the rotary arms 45 on the left and right sides can easily tilt in a direction toward the rotary shaft 32*a*1 of the timing drive roller 32*a*. Accordingly, especially when the transfer cover unit 8 is closed, the timing drive roller 32*a* and the rotary arm 45 tend to interfere with the parts provided in the main body 110, which can degrade the open and close operability of the transfer cover unit 8. To overcome this problem, the regulated portion 45*g* may be formed as needed.

The configuration according to this exemplary embodiment, the regulated portion 45*g* is formed as a tapered groove across the middle portion 45*f* in a slightly oblique direction. The regulated portion 45*g* is not limited to a groove shape or tapered groove, but the entire surface of the middle portion 45*f* can be formed as the regulated portion 45*g* or the bottom surface of the regulated portion 45*g* can be formed to have a round groove instead of the tapered groove, and other various shapes.

If the regulated portion 45*g* is formed in a gutter shape, the pivot 27*b* can guide the rotary arm 45. In FIG. 6C, the lower left end of the regulated portion 45*g* is the deepest surface of a tapered groove and the thickness to the opposite side of the rotary arm 45 is approximately half the thickness of plate of the middle portion 45*f*. The tapered groove of the regulated portion 45*g* moves to an upward direction as the regulated portion 45*g* extends from the left end to the upper right end, and the bottom surface of the regulated portion 45*g* becomes shallowest at the upper right end, and continues to the surface of the middle portion 45*f* at substantially the same height.

A stopper 48 is provided in the vicinity of the spring peg shaft 27*c* of the end plate 27, as illustrated in FIGS. 5A, 6A, and 12A through 12C. The stopper 48 is formed by lancing the end plate 27 and is configured to regulate the rotation position of the pressure lever 46 in the counterclockwise direction thereof by contacting the pressure lever 46 to the stopper 48 when the transfer cover unit 8 is opened. This regulation of the rotation range of the pressure lever 46 to the necessary minimum with the stopper 48 allows more space for the layout of parts disposed around the pressure lever 46 and reduces the parts cost by keeping the elasticity level to the necessary minimum. It is to be noted that, when the transfer cover unit 8 is closed, the pressure lever 46 is separated from the stopper 48 and a predetermined space S1 shown in FIG. 5A is formed between the pressure lever 46 and the stopper 48.

The moment of rotation of the pressure lever 46 is determined based on a governor gain between a distance from the hook 46*b* of the tension spring 47 to the pivot 27*b* and a distance from the pivot 27*b* to the pressure surface 46*c*. The configuration of this exemplary embodiment is designed to increase the force of the tension spring 47 due to the above-described governor gain of the distances so as to be transmitted to the pressed surface 45*c* of the rotary arm 45. Therefore, even with a small force of the tension spring 47, a large nip pressure of the timing roller can be generated. Accordingly, a necessary timing roller nip pressure can be gained by using the small tension spring 47.

As described above, by forming a hole through which the pivot 27*a* of the end plate 27 is inserted into the rotary arm 45 to the slot 45*a*, the rotary arm 45 can move in the longitudinal direction by a distance between the slot 45*a* and the pivot 27*a*. By so doing, the timing drive roller 32*a* can be pressed against the timing driven roller 32*b* reliably, and therefore a reliable nip pressure of the timing roller can be secured. It is to be noted that relative positions of the slot 45*a* and the pivot 27*a* can be switched. That is, by inserting a pivot formed on the base end section of the rotary arm 45 into a slot formed in the end plate 27, the same effect as that described above can be obtained.

Figure 14A:
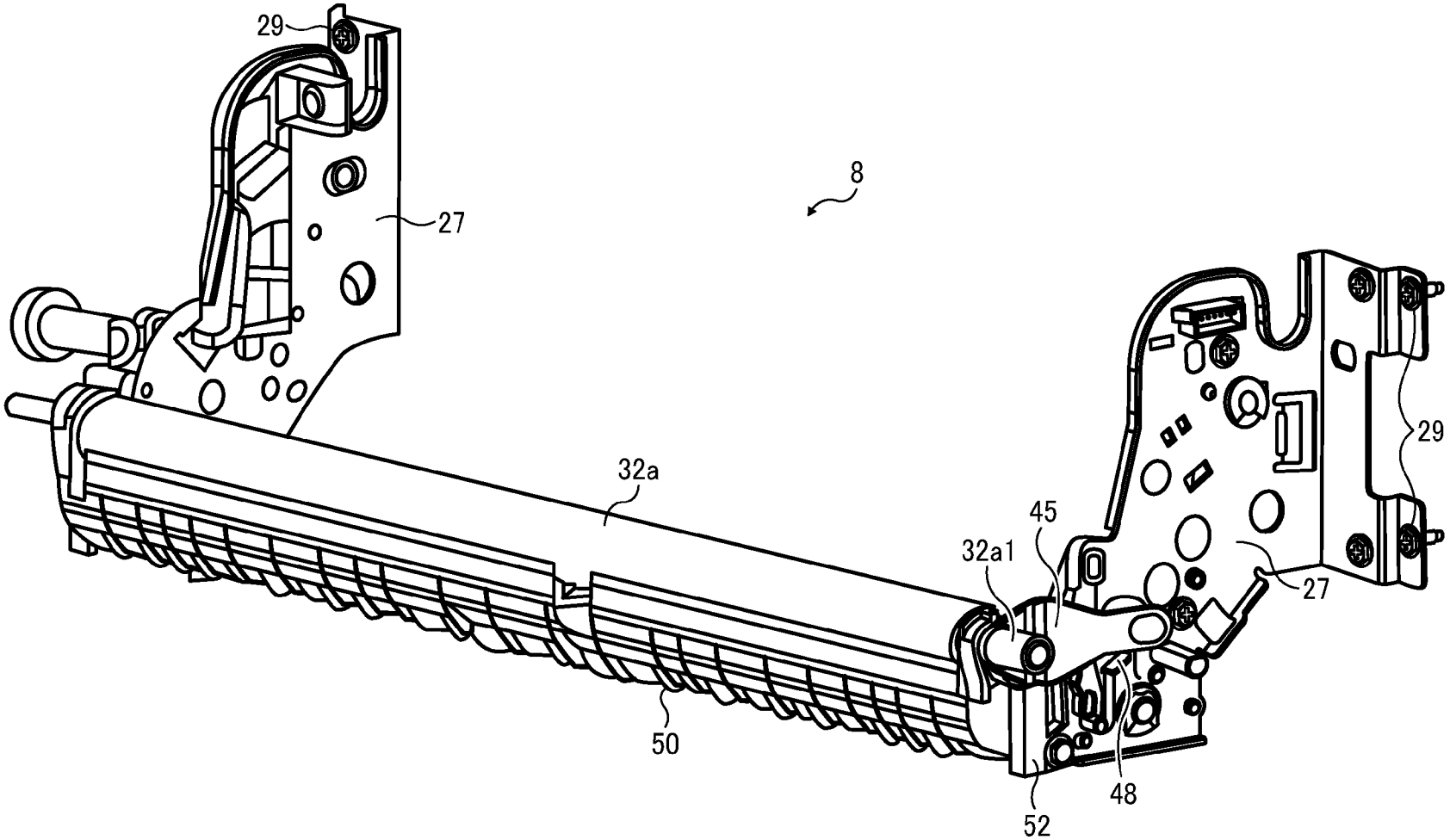
FIG. 14A is a perspective view illustrating a state of the timing drive roller on the inner surface of the transfer cover unit when the transfer cover unit is open.

In a state in which the transfer cover unit 8 is open, that is, an external force is not exerted on a circumferential surface of the timing drive roller 32*a*, the rotary arm 45 rotates due to the weight thereof about the pivot 27*a* in a direction to an extreme low side or in a counterclockwise direction, as illustrated in FIGS. 12A and 14A. Then, the rotary arm 45 contacts a stopper surface 52*b* disposed at the upper end of a support member 52 (described later) due to the weight thereof.

With the state as illustrated in FIG. 12A is maintained, the rotary arm 45 can move freely by a space within the slots 45*a* disposed on the left and right side of the pivot 27*a*. By contrast, the pressure lever 46 rotates to the limit in the counterclockwise direction by a force of the tension spring 47 and contacts the stopper 48. Accordingly, the rotary arm 45 and the pressure lever 46 are separated from each other and form a space S2 therebetween as illustrated in FIG. 12A.

[Sheet Feed Guide]

As illustrated in FIGS. 2, 4, 7A through 7C, a sheet feed guide 50 of the duplex unit 9 is disposed below the timing drive roller 32*a*. The sheet feed guide 50 is configured to guide the sheet S that is conveyed to the pair of timing rollers 32 to a correct position of the transfer nip portion. As illustrated in FIG. 2, a sheet feed guide 51 that works in a similar way to the sheet feed guide 50 is located on the main body 110 of the image forming apparatus 100 (see FIG. 9). The sheet feed guide 51 is disposed below the timing driven roller 32*b*.

In a known image forming apparatus, a sheet feed guide that is similar to the sheet feed guide 50 is fixedly mounted on the inside surface of a conveyance housing that is similar to the conveyance housing 9*a*. By contrast, in the exemplary embodiment of the present invention, the timing drive roller 32*a* is rotatably disposed with respect to the conveyance housing 9*a*, and therefore, if the sheet feed guide 50 is fixedly mounted on the conveyance housing 9*a*, it is likely that the timing drive roller 32*a* interferes with the sheet feed guide 50.

Further, if the sheet feed guide 50 is sufficiently separated from the timing drive roller 32*a* to avoid the above-described interference, a gap between the timing drive roller 32*a* and the sheet feed guide 50 becomes too large. As a result, it is difficult to guide the sheet S to the timing roller nip portion reliably, which can cause a paper jam more frequently due to the large gap.

Therefore, in the exemplary embodiment of the present invention, the sheet feed guide 50 is rotatably disposed to the conveyance housing 9*a*, together with the timing drive roller 32*a*. The sheet feed guide 50 includes bearings 50*a* at an upper end of each side thereof, and the rotary shaft 32*a*1 of the timing drive roller 32*a* is rotatably engaged with the bearings 50*a*. In FIG. 7C, the timing drive roller 32*a* is fitted to one of the bearings 50*a*. Since the bearings 50*a* are disposed on both sides of the sheet feed guide 50 to do the same operation, a description of the bearings 50*a* will be give in the singular form for simplicity. Similarly, other parts, units, and components disposed or arranged on or in the vicinity of both sides of the sheet feed guide 50 may be described in the singular accordingly.

A part of the bearing 50*a* is cut out into a C-shape viewed from the side of the sheet feed guide 50 (i.e., viewed from the front of FIG. 7C). The rotary shaft 32*a*1 of the timing drive roller 32*a* can be engaged with the bearing 50*a* of the sheet feed guide 50 by pushing the rotary shaft 32*a*1 from the opening in the C-shape of the bearing 50*a* until it clicks.

By engaging the rotary shaft 32*a*1 of the timing drive roller 32*a* with the bearing 50*a* of the sheet feed guide 50 as described above, the bearing 50*a* of the sheet feed guide 50, that is, the lower end of the sheet feed guide 50 can be moved together with the timing drive roller 32*a*. Therefore, the gap between the downstream edge of the sheet feed guide 50 and the timing drive roller 32*a* can be constantly maintained at the necessary minimum gap. Accordingly, the sheet S can be fed to the timing roller nip portion reliably, and can prevent occurrence of paper jam with the sheet S biting into the gap.

Figure 7A:
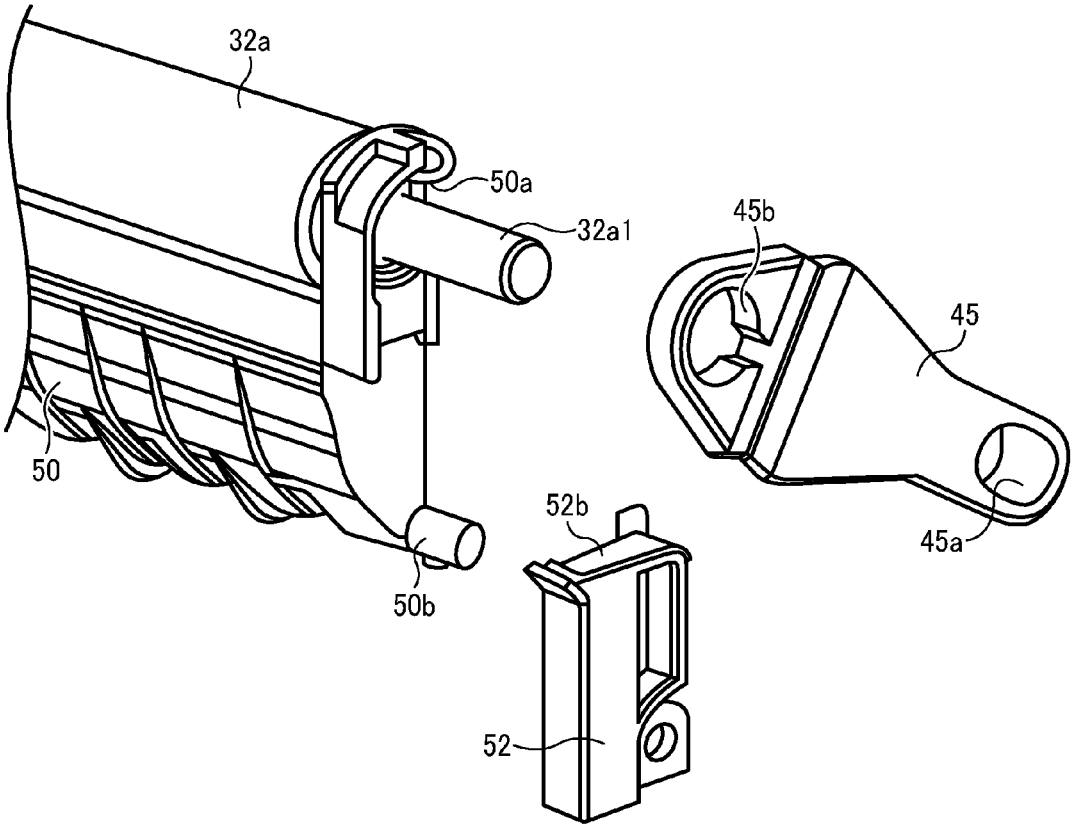
FIG. 7A is a perspective view illustrating one end of the timing drive roller and a sheet feed guide.

A minor axis boss 50*b* is integrally mounted at the lower end of the sheet feed guide 50, as illustrated in FIG. 7A. Further, as illustrated in FIGS. 7A and 7B, a support member 52 is disposed at the lower portion of both ends of the rotary shaft 32*a*1 of the timing drive roller 32*a* to guide the boss 50*b* in the vertical direction and is fixedly screwed to the end plate 27.

Figure 7B:
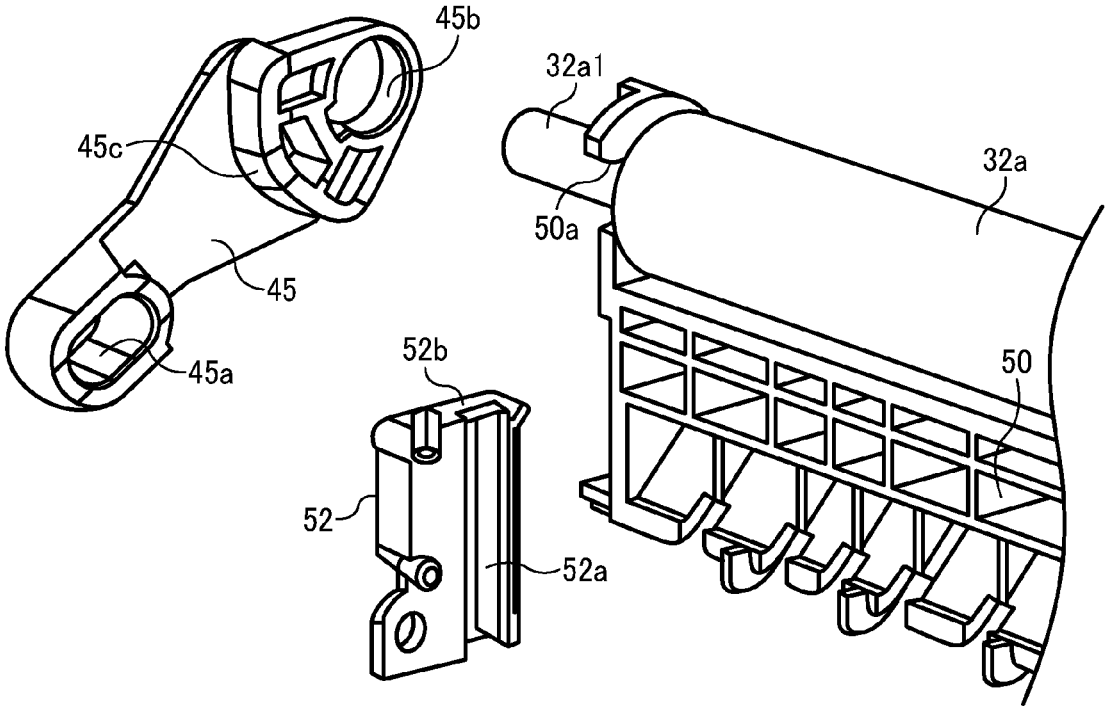
FIG. 7B is a perspective view illustrating the other end of the timing drive roller and the sheet feed guide.
Figure 7C:
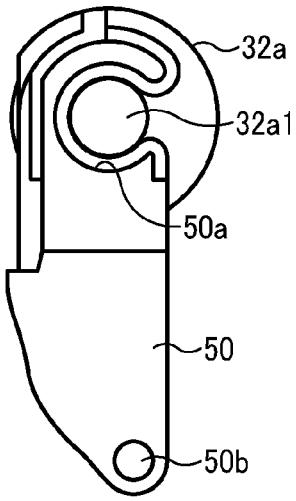
FIG. 7C is a side view illustrating one end of the timing drive roller and the sheet feed guide.

The support member 52 includes a long groove 52*a* disposed facing both ends of the sheet feed guide 50, as illustrated in FIG. 7B. The long groove 52*a* is designed to guide the boss 50*b* of the sheet feed guide 50 in the vertical direction and extends in the vertical direction with a constant width slightly greater than a diameter of the boss 50*b*. By slidably engaging the boss 52*b* of the sheet feed guide 50 with the long groove 52*a*, the position or path of the upper end of the sheet feed guide 50 is regulated by the long groove 52*a* when the sheet feed guide 50 moves along with movement of the timing drive roller 32*a*.

Figure 8:
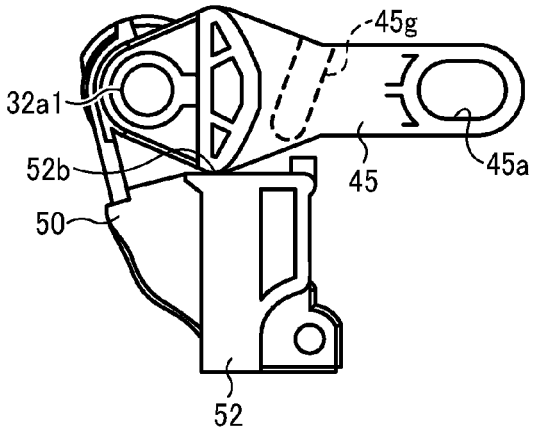
FIG. 8 is a side view illustrating the sheet feed guide, the rotary arm, and a support member.

As illustrated in FIG. 8, the support member 52 is located below the rotary arm 45. The upper end of the support member 52 forms a flat stopper surface 52*b* so that the lower surface of the rotary arm 45 can contact the stopper surface 52*b*. Further, when the force exerted by the tension spring 47 is not transmitted to the rotary arm 45 via the pressure lever 46 (i.e., when the pressure lever 46 is rotated by the force exerted by the tension spring 47 to the end of the counterclockwise direction enough to contact the stopper 48), the rotary arm 45 contacts the stopper surface 52*b* of the support member 52 due to the weight thereof to regulate the position thereof, as described above.

When a user keeps the transfer cover unit 8 open for a certain period of time for removing jammed papers, it can happen that the user inadvertently touches and displaces the timing drive roller 32*a* from the transfer cover unit 8. At this time, if the user tries to move the timing drive roller 32*a* together with the sheet feed guide 50 beyond its movable range, an excess load can be applied on the sheet feed guide 50, and it is likely to damage or break the sheet feed guide 50.

Therefore, as illustrated in FIG. 8, the stopper surface 52*b*, for example, is formed on the support member 52 as a part of the transfer cover unit 8 so as to cause the rotary arm 45 to contact the stopper surface 52*b* of the support member 52. By so doing, the rotary arm 45 and the timing drive roller 32*a* cannot be moved further. With this configuration, these parts can be prevented from damage or breakage reliably.

[Positioning Guide Member]

Figure 9:
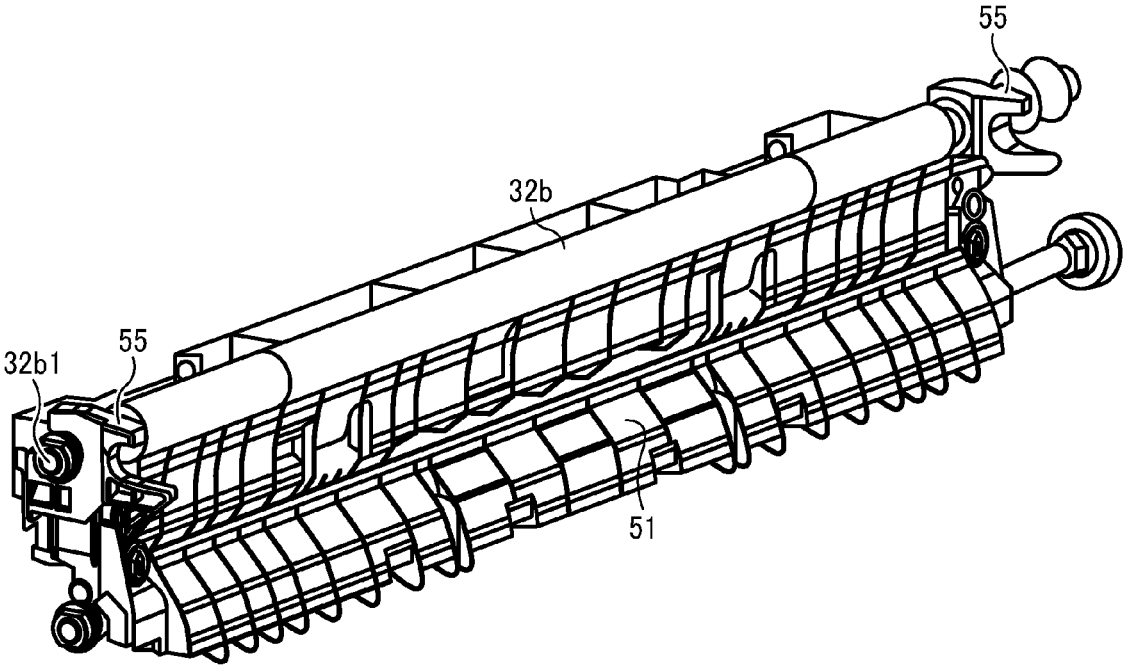
FIG. 9 is a perspective view illustrating a timing driven roller and the sheet feed guide.

Further, the timing driven roller 32*b* as illustrated in FIG. 9 is provided to the main body 110 of the image forming apparatus 100. The timing driven roller 32*b* of the main body 110 of the image forming apparatus 100 and the timing drive roller 32*a* provided to the transfer cover unit 8 contact each other to form a timing mechanism composed of the pair of timing rollers 32.

Figure 10:
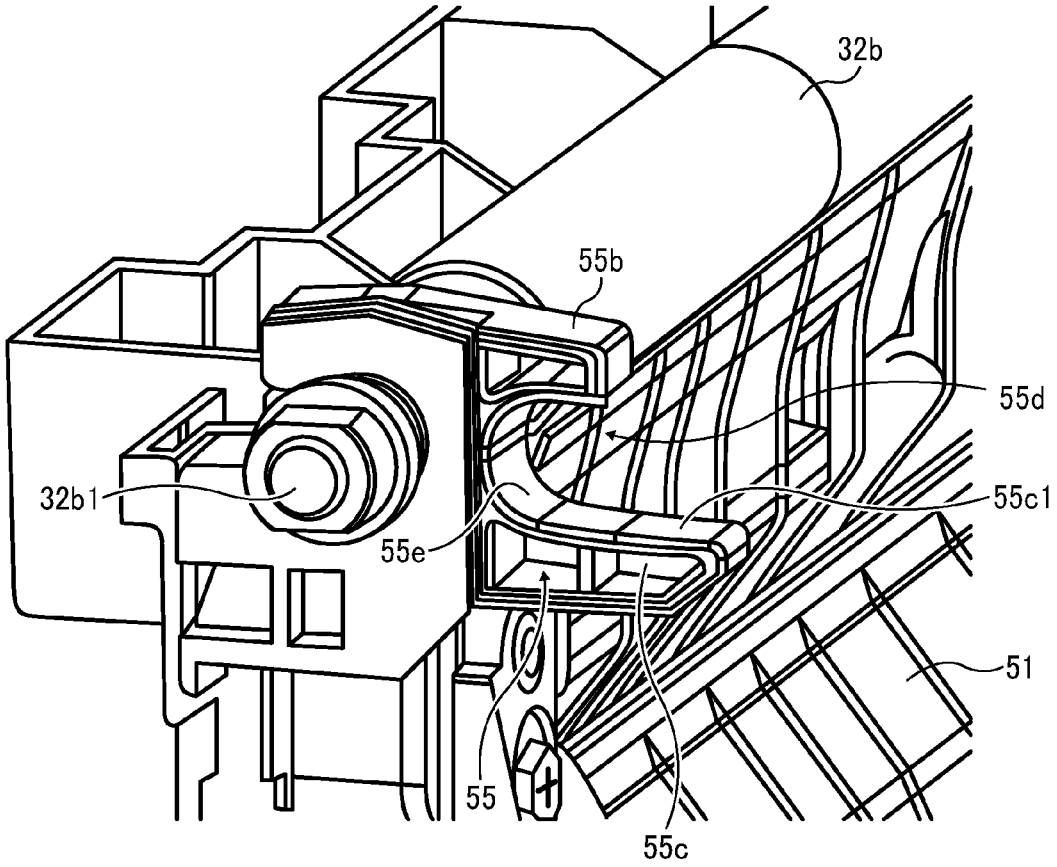
FIG. 10 is a perspective view illustrating one end of the timing driven roller and the sheet feed guide.
Figure 11:
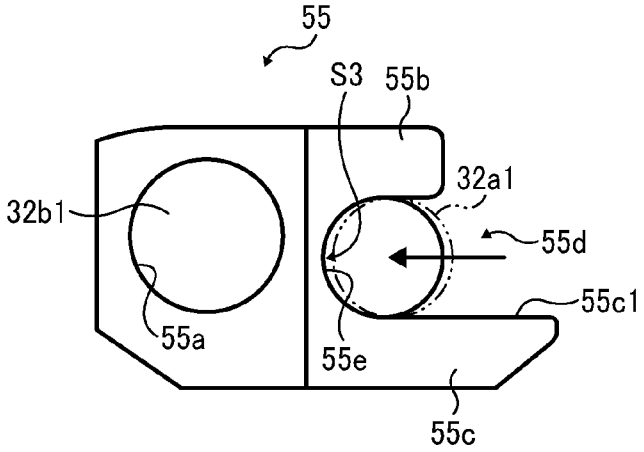
FIG. 11 is a side view illustrating a positioning guide member.

As illustrated in FIGS. 9, 10, and 11, a positioning guide member 55 is disposed at both ends of the rotary shaft 32*b*1 of the timing driven roller 32*b* for positioning the timing drive roller 32*a* with respect to the timing driven roller 32*b*. The positioning guide member 55 includes a bearing 55*a*, an upper jaw 55*b*, and a lower jaw 55*c*. The bearing 55*a* engages the rotary shaft 32*b*1 of the timing driven roller 32*b*, as illustrated in FIG. 11. The upper jaw 55*b* and the lower jaw 55*c* horizontally protrude toward the front side of the image forming apparatus 100, that is, toward the transfer cover unit 8. The lower jaw 55*c* protrudes beyond the upper jaw 55*b*. An opening 55*d* that opens toward the upper oblique direction is formed between the upper jaw 55*b* and the lower jaw 55*c*.

Accordingly, the opening 55*d* has a rake shape that can smoothly receive the rotary shaft 32*a*1 of the timing drive roller 32*a* from the upper oblique direction. This rake-shaped opening 55*d* can prevent damage or breakage of the rotary shaft 32*a*1 of the timing drive roller 32*a* due to interference with the positioning guide member 55 when the rotary shaft 32*a*1 is lifted from the lower jaw 55*c* before reaching the inward portion of the positioning guide member 55.

The opposite side of the opening 55*d* forms an arc-shaped end 55*e*. Both ends of the rotary shaft 32*a*1 of the timing drive roller 32*a* proceed in a horizontal direction toward the arc-shaped end 55*e* at the last step for closing the transfer cover unit 8. However, both ends of the rotary shaft 32*a*1 cannot proceed over the position immediately before a portion at which the rotary shaft 32*a*1 contacts the arc-shaped end 55*c* at the maximum. That is, there is a small space S3 between the rotary shaft 32*a*1 and the arc shaped end 55*e* of the positioning guide member 55 when the transfer cover unit 8 completely closed.

The space S3 is necessary to form a given nip pressure of the pair of timing rollers 32. If there is the space S3, the position of the outer circumferential surface of the timing drive roller 32*a* may be based on the arc shaped end 55*e*, which may produce small variations in dimensional accuracy of each of multiple parts disposed from the rotary shaft 32*a*1 to the outer circumferential surface of the timing drive roller 32*a* and be accumulated to cause a larger variation of the nip pressure. Further, the nip pressure can vary due to deterioration due to age such as wear on the outer circumferential surface of the timing drive roller 32*a*. Accordingly, providing the space S3 can prevent the above-described issue.

The lower jaw 55*c* of the positioning guide member 55 includes an upper surface 55*c*1 to guide the rotary shaft 32*a*1 of the timing drive roller 32*a* so that the rotary shaft 32*a*1 can slidably move on the upper surface 55*c*1 while pressing the upper surface 55*c*1. The upper surface 55*c*1 of the lower jaw 55*c* is formed in a straight shape so that a proper and precise nip portion can be formed between the timing driven roller 32*b* and the timing drive roller 32*a*. With this configuration, variation in relative positions between the rotary shaft 32*b*1 of the timing driven roller 32*b* and the rotary shaft 32*a*1 of the timing drive roller 32*a* can be reduced significantly, thereby providing accurate timing performance and precise skew calibration.

It is to be noted that the term "in a straight shape" does not indicate a perfect straight shape only but includes a shape substantially straight toward the timing driven roller 32*b*. A path along the straight-shaped upper surface 55*c*1 of the lower jaw 55*c* on which the rotary shaft 32*a*1 of the timing drive roller 32*a* moves is a second transit path of the rotary shaft 32*a*1 (See FIG. 12B).

Further, a positioning guide member having a similar structure to the positioning guide member 55 may be disposed in the vicinity of both ends of the rotary shaft of the drive roller 18 of the intermediate transfer belt 16 provided to the main body 110 of the image forming apparatus 100 so that the relative positioning accuracy of the transfer roller 20 and the drive roller 18 can be secured with the positioning guide member.

[Opening and Closing of the Transfer Cover Unit and Operation of the Timing Drive Roller]

FIGS. 12A through 12C show final steps for closing the transfer cover unit 8 in order. FIG. 12A illustrates a state immediate before the rotary shaft 32*a*1 of the timing drive roller 32*a* contacts the positioning guide member 55. The relative positions of the timing drive roller 32*a* and other members with respect to the transfer cover unit 8 never change, that is, remain completely the same from when the transfer cover unit 8 is fully opened as illustrated in FIGS. 3 and 4 to the state illustrated in FIG. 12A.

When the transfer cover unit 8 is rotated, no parts can be disposed within a range of an arc-shaped transit path drawn by the secondary transfer roller 20 and the timing drive roller 32*a* (e.g., a transit path A1 drawn by the timing drive roller 32*a* in FIG. 12A). The parts disposed on the main body 110 side that can interfere with the secondary transfer roller 20 and the timing drive roller 32*a* are, for example, the fixing unit 34, the intermediate transfer belt 16 (the photoconductor drum 2K in a black-and-white image forming apparatus), and the drive roller 18 as illustrated in FIGS. 2 and 4.

For recently marketed image forming apparatuses, the need for a compact layout has caused a pair of timing rollers to be located close to a photoconductor drum serving as an image carrier and the lower portion at one end of an intermediate transfer belt. In such a layout of parts for a compact configuration, it is highly likely that the arc-shaped transit path A1 of the timing drive roller 32*a* intersects the intermediate transfer belt 16 and the drive roller 18. That is, when opening and closing the transfer cover unit 8, the transit path A1 of the timing drive roller 32*a* can easily intersect the intermediate transfer belt 16 and the drive roller 18. Specifically, when the pair of timing rollers 32 is located slightly inward from the transfer nip portion of the intermediate transfer belt 16 due to the sheet conveyance path, the possibility of interference of the timing drive roller 32*a* with the intermediate transfer belt 16 increases dramatically.

Further, to achieve an entirely compact image forming apparatus, it is necessary to reduce the height thereof. However, if the image forming apparatus becomes smaller in height, a rotation radius R1 from the rotary shaft 12 of the transfer cover unit 8 to the timing drive roller 32*a* is shortened. With this configuration, the transit path A1 of the timing drive roller 32*a* approaches the intermediate transfer belt 16, and therefore the transit path A1 of the timing drive roller 32*a* may be an obstacle to a reduction in height of the image forming apparatus 100.

The configuration of this exemplary embodiment of the present invention is designed such that, while the pair of timing rollers 32 is located immediately below and inward (left side) from the drive roller 18 of the intermediate transfer belt 16 to reduce the size of the image forming apparatus 100 in both a vertical direction and a horizontal direction as illustrated in FIG. 2, the transit path A1 of the timing drive roller 32*a* can be avoided by the intermediate transfer belt 16 and the drive roller 18 as shown in FIGS. 12A through 12C and 13A through 13C and as described below.

In the state illustrated in FIG. 12A, while the rotary arm 45 contacts the stopper surface 52*b* of the support member 52 due to the weight thereof, the pressure lever 46 contacts the stopper 48 with the force of the tension spring 47. A space S2 is defined between the rotary arm 45 and the pressure lever 46, specifically, between the pressure surface 46*c* of the pressure lever 46 and the pressure surface 45*c* of the rotary arm 45.

Accordingly, the rotary arm 45 and the timing drive roller 32*a* are rotatable to the right and upward from the state illustrated in FIG. 12A within the space S2. It is to be noted that, if the regulated portion 45*g* is provided to the rotary arm 45 as described above, the leading edge of the pivot 27*b* that serves as a regulating member is located at an entrance edge where the depth of the regulated portion 45*g* is deepest in the state illustrated in FIG. 12A. At this position, the leading edge of the pivot 27*b* either does not contact the regulated portion 45*g* or only slightly touches the regulated portion 45*g*.

After the transfer cover unit 8 is rotated about the rotary shaft 12 in a clockwise direction from the state illustrated in FIG. 12A, the rotary arm 45 tilts in a lower right direction and slidably moves toward the pivot 27*a* due to the weight thereof while contacting the stopper surface 52*b* at the upper end of the support member 52. By so doing, the amount of projection of the timing drive roller 32*a* toward the inside surface of the transfer cover unit 8 is reduced, thereby lowering the possibility that a user touches the timing drive roller 32*a* inadvertently when the user opens the transfer cover unit 8 for removing jammed papers.

Further, the position of the rotary arm 45 moved to the pivot 27*a* due to the weight thereof may be maintained until at least the rotary arm 45 contacts the stopper surface 52*b* at the upper end of the support member 52 when the transfer cover unit 8 is being closed. Therefore, as described above, a non-interference range between the timing drive roller 32*a* and the parts in the main body 110 of the image forming apparatus 100 can be largely obtained by the amount that the protruding amount of the timing drive roller 32*a* is reduced due to movement with the weight thereof.

FIG. 12B illustrates a state immediately before the transfer cover unit 8 is completely closed. This state of FIG. 12B shows that the rotary shaft 32*a*1 of the timing drive roller 32*a* contacts the upper surface 55*c*1 of the lower jaw 55*c* of the positioning guide member 55 and the rotary arm 45 starts to lift up from the support member 52.

In this state, the space S2 is still preserved between the rotary arm 45 and the pressure lever 46. The force exerted by the tension spring 47 is received by the stopper 48, and therefore does not affect the rotary arm 45. Accordingly, even if the transfer cover unit 8 is being closed further from the state in FIG. 12B, the rotary arm 45 can freely rotatable in a clockwise direction (i.e., in a direction the rotary arm 45 moves up from the support member 52) until the space S2 is no longer reserved.

It is to be noted that, when the regulated portion 45*g* is formed on the rotary arm 45, the leading edge of the pivot 27*b* that serves as a regulating member in the state of FIG. 12B is located in a middle portion toward a location slightly inward from the opening end of the regulated portion 45*g*. At this position, the looseness or play between the leading edge of the pivot 27*b* and the regulated portion 45*g* of the rotary arm 45 becomes smaller than that in the state in FIG. 12A. If the rotary arms 45 disposed at the left and right sides of the rotary shaft 32*a*1 are tilted inwardly, the leading edge of the pivot 27*b* contacts the regulated portion 45*g* to displace the rotary arm 45 outwardly for collecting the tilt of the rotary arms 45.

By so doing, even if there is some play between the slot 45*a* and the pivot 27*a*, the positions of the timing drive roller 32*a* and the rotary arm 45 are corrected due to an increase in horizontal parallelism of the rotary arms 45 at the left and right sides of the rotary shaft 32*a*1 and in verticality of the rotary arm 45 with respect to the rotary shaft 32*a*1. Thereafter, when the transfer cover unit 8 is being closed, the interference of the timing drive roller 32*a* and the rotary arm 45 with the parts provided in the main body 110 of the image forming apparatus 100 can be prevented. Especially, by providing a tapered surface or a round surface to the regulated portion 45*g*, even if the transfer cover unit 8 is bent or the rotary arm 45 is tilted due to this looseness, the position of the rotary arm 45 is corrected satisfactorily to effectively avoid the interference of the timing drive roller 32*a* and the rotary arm 45 with the parts in the main body 110 of the image forming apparatus 100.

As the transfer cover unit 8 is being closed further from the state of FIG. 12B, the rotary shaft 32*a*1 of the timing drive roller 32*a* is supported by the upper surface 55*c*1 of the positioning guide member 55 to cause the height of the rotary shaft 32*a*1 to remain constant while the height of the pivot 27*a* of the rotary arm 45 lowers. Therefore, the rotary arm 45 rotates in the clockwise direction gradually. Then, when the space S2 disappears and the rotary arm 45 contacts the pressure lever 46, the biasing force of the tension spring 47 may be exerted on the pressure lever 46. That is, at the same time that the rotary arm 45 contacts the pressure lever 46, the pressure lever 46 separates from the stopper 48, which generates the space S1 therebetween, and the biasing force of the tension spring 47 is transmitted from the leading edge pressure surface 46*c* of the pressure lever 46 to the pressed surface 45*c* of the rotary arm 45.

Figure 14B:
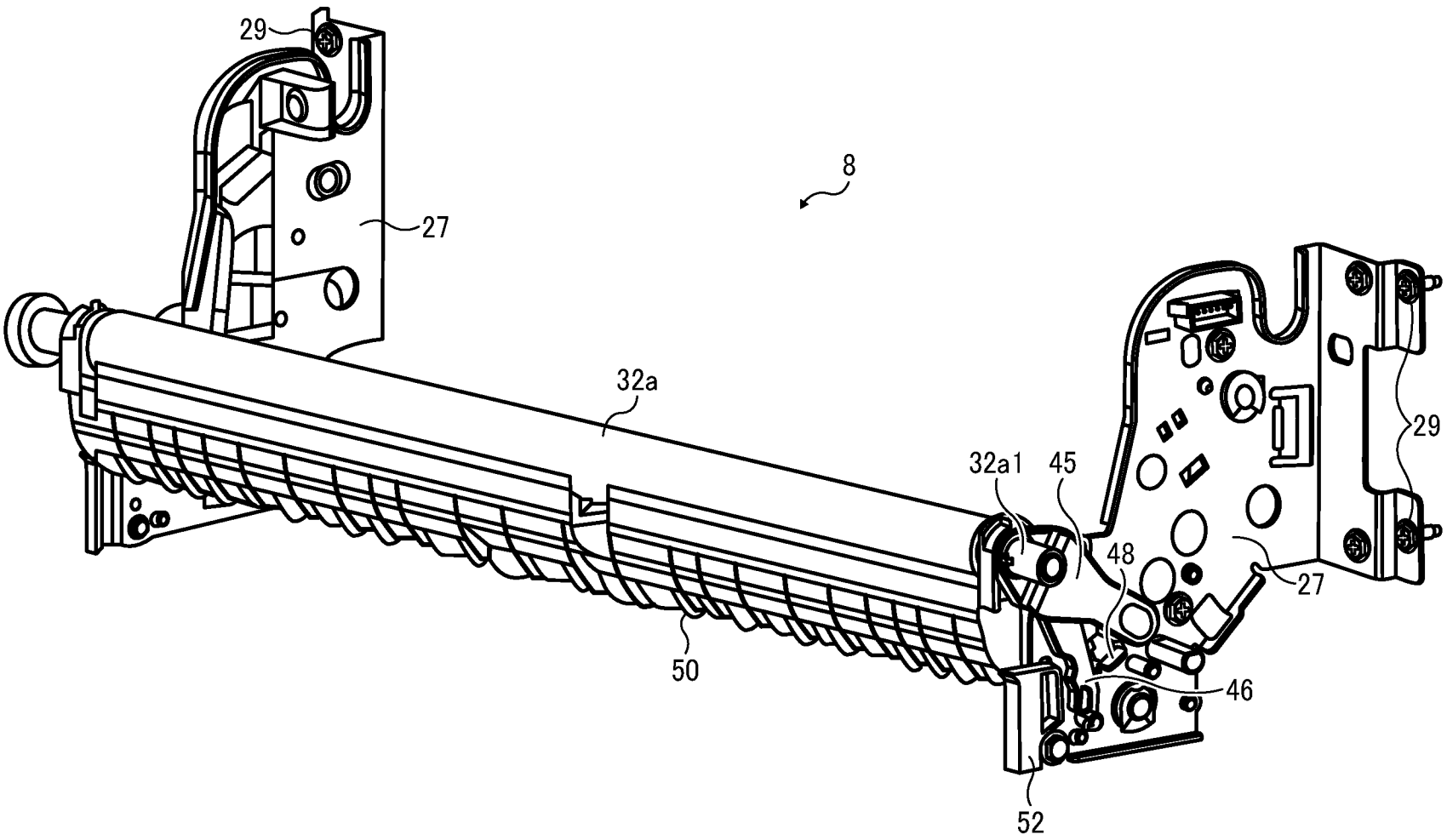
FIG. 14B is a perspective view illustrating a state of the timing drive roller on the inner surface of the transfer cover unit with the transfer cover unit is closed.

FIG. 12C illustrates a state in which the transfer cover unit 8 is completely closed (refer to FIG. 14B for an inside surface of the transfer cover unit 8). In this state of FIG. 12C, the biasing force of the tension spring 47 is transmitted via the pressure lever 46 to the rotary arm 45 and, as a result, the rotary arm 45 is rotatably biased about the pivot 27*a* in a counterclockwise direction. Since the rotary shaft 32*a*1 of the timing drive roller 32*a* is guided along the upper surface 55*c*1 of the lower jaw 55*c* of the positioning guide member 55 (not illustrated in FIG. 12C) to the left in a horizontal direction, the rotary shaft 32*a*1 of the timing drive roller 32*a* is actually shifted and biased in a straight direction toward the rotary shaft 32*b*1 of the timing driven roller 32*b* (i.e., in a direction of separating from the pivot 27*a*) due to the biasing force exerted on the rotary shaft 45. Accordingly, the pivot 27*a* of the rotary arm 45 relatively moves to the vicinity of the right edge of the slot 45*a* in the state of FIG. 12C, in which the rotary arm 45 extends in a radial outward direction to the maximum not only about the pivot 27*a* but also about the rotary shaft 12 of the transfer cover unit 8.

It is to be noted that, if the regulated portion 45*g* is provided to the rotary arm 45, the leading edge of the pivot 27*b* that serves as a regulating member is located at an extreme inward portion where the depth of the regulated portion 45*g* is shallowest in the state of FIG. 12C. With this action, when the leading edge of the pivot 27*b* contacts lightly or faces the extreme inward portion of the regulated portion 45*g* with the minimum looseness, the accuracy in positions of the pair of rotary arms 45 and the timing drive roller 32*a* may be enhanced.

It is to be noted that, if the leading edges of the pivots 27*b* disposed on the left and right sides contact the regulated portion 45*g*, a contact pressure is exerted therebetween, and therefore it is likely that the friction force exerted between the leading edges of the pivots 27*b* and the regulated portion 45*g* prevents the biasing force exerted by the tension spring 47 to effectively act as a nip force of the timing drive roller 32*a*. Therefore, in the state as illustrated in FIG. 12C, it is preferable that the leading edge of one end of the pivot 27*b* is minimally separated from the regulated portion 45*g* even if the leading edge at the other end of the pivot 27*b* contacts the regulated portion 45*g*. It is also possible to cause the leading edges of both ends of the pivot 27*b* to contact the regulated portion 45*g* without any looseness in the state as illustrated in FIG. 12C.

With this condition, the timing drive roller 32*a* contacts the timing driven roller 32*b* to form a nip portion therebetween, which composes a timing mechanism including the pair of timing rollers 32. Further, the transfer roller 20 contacts the drive roller 18 of the intermediate transfer belt 16 via the intermediate transfer belt 16 with the biasing force exerted by the compression spring 25, and therefore a transfer nip pressure is generated between the transfer roller 20 and the end portion of the intermediate transfer belt 16 supported by the drive roller 18.

The rotary shaft 32*a*1 of the timing drive roller 32*a* contacts the upper surface 55*c*1 of the lower jaw 55*c* of the positioning guide member 55 and then maintains the state of contact with the upper surface 55*c*1 of the lower jaw 55*c* constantly until the timing mechanism is composed as described above. A known positioning mechanism of a roller guides a roller shaft along a guide groove of a guide unit including upper and lower jaws provided to a main body of an apparatus, and the direction of the force exerted by a spring biasing the roller is aligned with the direction in which the guide groove extends.

The above-described known positioning mechanism does not clearly show whether the roller shaft is guided by the upper jaw or the lower jaw in the above-described roller biasing mechanism, and therefore it may not be clearly determined whether the final position of the roller is guided based on the upper jaw or the lower jaw. By contrast, the exemplary embodiment of the present invention, guides the rotary shaft 32*a*1 of the timing drive roller 32*a* by the upper surface 55*c*1 of the lower jaw 55*c* until the timing mechanism is conformed, and therefore the above-described problem will not be raised.

Further, the biasing force of the tension spring 47 is transmitted via the pressure lever 46 to the rotary arm 45 in the exemplary embodiment of the present invention. The rotary arm 45 can be rotatably biased to the counterclockwise direction and, at the same time, to the direction toward the slot 45*a*. Further, as described above, the roller shaft 32*a*1 can be positioned based on the upper surface 55*c*1 of the lower jaw 55*c* while the biasing force exerted by the tension spring 47 can be used for generating the nip pressure of the pair of timing rollers 32. While a known roller biasing mechanism can form a nip pressure using a spring but, as described above, the rollers cannot be positioned reliably.

In the timing mechanism implemented by the pair of timing rollers 32, a mechanism for positioning the timing drive roller 32*a* with respect to the timing driven roller 32*b* includes the upper surface 55*c*1 of the lower jaw 55*c* of the positioning guide member 55, the rotary shaft 32*a*1 of the timing drive roller 32*a* that is guided by the upper surface 55*c*1 of the lower jaw 55*c*, and the entire outer circumferential surface of the timing drive roller 32*a*. Even if a base end of the rotary arm 45 is loosened in a space between the support pin 27*a* and the slot 45*a*, this looseness does not adversely affect the position of the timing drive roller 32*a*.

This positioning mechanism can be made simpler and smaller than a mechanism disclosed in a known configuration. Further, the outer circumferential surface of the timing drive roller 32*a* is positioned toward the outer circumferential surface of the timing driven roller 32*b* with the timing drive roller 32*a* biased and guided linearly. Therefore, as previously described, even if the dimensional accuracy of parts of the timing drive roller 32*a* varies and/or an outer circumferential surface of the timing drive roller 32*a* is worn and deteriorated due to age, the nip pressure of the pair of timing rollers 32 does not vary.

The timing drive roller 32*a* receives the reaction force exerted by the nip portion from the timing driven roller 32*b*, and the rotary arm 45 is pressed back in a longitudinal direction to the base end side and the clockwise direction due to the reaction force. By contrast, the reaction force of the nip portion of the pair of timing rollers 32 is transmitted via the rotary arm 45 to the pressed surface 46*c* of the pressure lever 46. With this action, the pressure lever 46 is slightly pressed back in the clockwise direction, and therefore the tension spring 47 is slightly extended. At this time, the space S1 remains between the pressure lever 46 and the stopper 48, and the biasing force exerted by the tension spring 47 is increased by the governor gain of the pressure lever 46 (i.e., a ratio of a distance between the hook 46*b* of the tension spring 47 and the pivot 27*b* and a distance between the pivot 27*b* and the pressed surface 46*c*), so as to be affected to the nip pressure.

As described above, referring to FIGS. 12A through 12C, the final steps of closing the transfer cover unit 8 in order was explained.

Figure 13A:
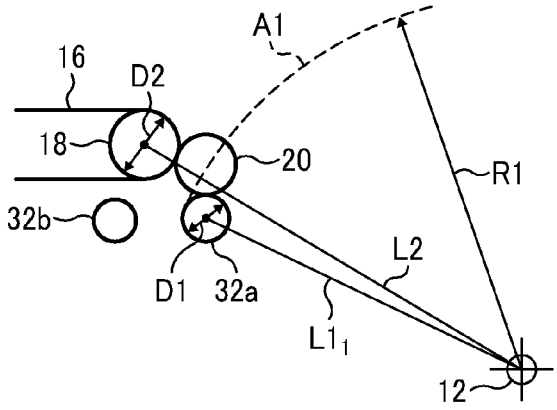
FIG. 13A is a diagram illustrating a transit path of the timing drive roller when opening and closing the transfer cover unit, corresponding to the state of FIG. 12A.
Figure 13B:
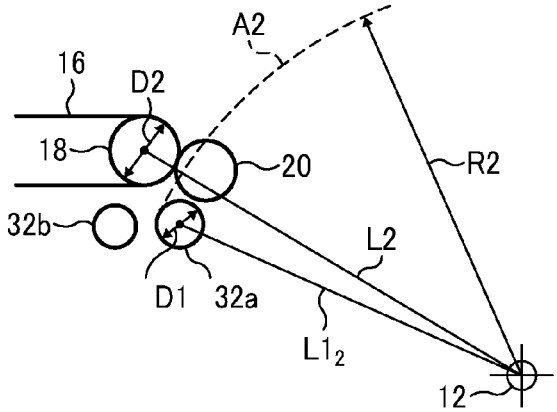
FIG. 13B is a diagram illustrating a transit path of the timing drive roller when opening and closing the transfer cover unit, corresponding to the state of FIG. 12B.
Figure 13C:
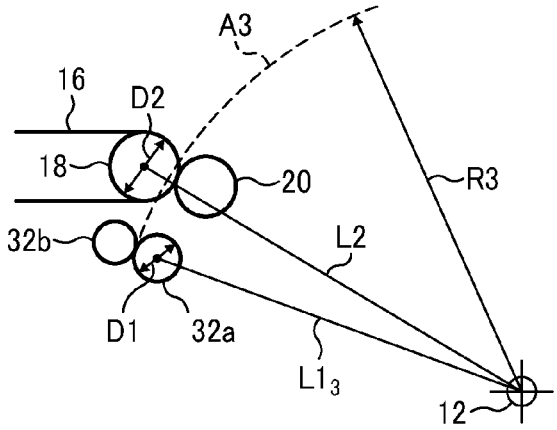
FIG. 13C is a diagram illustrating a transit path of the timing drive roller when opening and closing the transfer cover unit, corresponding to the state of FIG. 12C.

Next, a description is given of the transit path of the timing drive roller 32*a* in opening and closing the transfer cover unit 8, referring to FIGS. 13A through 13C.

FIGS. 13A through 13C correspond to FIGS. 12A through 12C, respectively, and reference numeral "12" indicates the rotary shaft 12 of the transfer cover unit 8. An actual transit path of the timing drive roller 32*a* corresponds to the transit path (the track of rotation) A1 as illustrated in FIG. 13A. Transit paths A2 and A3 illustrated in FIGS. 13B and 13C, respectively, are virtual transit paths used to explain a relation of interference with the intermediate transfer belt 16 and the drive roller 18.

As described above, as described above, the rotary arm 45 in FIG. 13A remain in contact with the stopper surface 52*b* of the support member 52 due to the weight thereof and, when the transfer cover unit 8 is opened or closed, the outward point of an outer circumferential surface of the timing drive roller 32*a* draws the transit path, that is, the transit path A1 about the rotary shaft 12 from the state of FIG. 12A to the outward side of the image forming apparatus 100. The radius R1 of the transit path A1 can be expressed as $L1_1+D1/2$, where "L1" represents a distance from the rotary shaft 12 to the center of the rotary shaft 32*a*1 of the timing drive roller 32*a* and "D1" represents a diameter of the timing drive roller 32*a*. Accordingly, the intermediate transfer belt 16 and the drive roller 18, both provided to the main body 110 of the image forming apparatus 100, do not interfere with the transit path A1. That is, the relative positions can be expressed as $L1_1+D1/2<L2-D2/2$, where "L2" represents a distance from the rotary shaft 12 to the center of the rotary shaft 32*b*1 of the timing driven roller 32*b*, and "D2" represents a diameter of the timing driven roller 32*b*.

By contrast, the transfer roller 20 has already contacted the drive roller 18 of the intermediate transfer belt 16 in FIG. 13A. As the transfer cover unit 8 is being closed further, the compression spring 25 between the transfer roller 20 and the transfer cover unit 8 are pressed with the contact condition maintained (as illustrated in FIGS. 2 and 4).

Next, in FIGS. 13B and 13C, the length indicated as $L1_1$ becomes shorter in order of $L1_1$, $L1_2$, and $L1_3$, expressed as $L1_3<L1_2<L1_1$. Because the rotary shaft 32*a*1 of the timing drive roller 32*a* contacts the upper surface of 55*c*1 of the lower jaw 55*c* of the positioning guide member 55, the rotary arm 45 that supports the timing drive roller 32*a* rotates about the pivot 27*a* in the clockwise direction, as illustrated in FIGS. 12B and 12C. As a result, a radius R2 of the transit path A2 is expressed as $L1_2+D1/2$ ($L1_2<L1_1$) in FIG. 13B and a radius R3 of the transit path A3 is expressed as $L1_3+D1/2$ ($L1_2<L1_1$) in FIG. 13C.

Here, it is assumed that the timing drive roller 32*a* is rotated about the rotary shaft 12 in the clockwise direction from the state of FIG. 13C, that is, that the transfer cover unit 8 is opened without rotating the rotary arm 45 to the end plate 27 and the transfer cover unit 8. This assumption is to check the degree of interference with the parts of the main body 110 when the rotary shaft 32*a*1 of the timing drive roller 32*a* is fixedly disposed to the transfer cover unit 8.

In this case, as indicated by the transit path A3 illustrated in FIG. 13C, the timing drive roller 32*a* interferes with the end portion of the intermediate transfer belt 16 located in the main body 110 of the image forming apparatus 100. At this time, a radius R3 of the transit path A3 is expressed as $L1_3+D1/2$ in the relation expressed as $L1_3+D1/2>L2-D2/2$.

Specifically, compared to the states of FIGS. 13A and 13B, the magnitude relationship of the sign of inequality is reversed in FIG. 13C. In other words, compared to a known device, the configuration in this exemplary embodiment can achieve a reduction in size of the image forming apparatus 100 by a space in which at least the transit path A3 is overlapping the position of the drive roller 18. This is because, compared to FIG. 13A (and FIG. 12A), the rotary arm 45 rotates in the clockwise direction to the end plate 27 and is shifted to a direction separating from the pivot 27*a* due to the biasing force exerted between the pressure lever 46 and the tension spring 47, and the radius R3 of the transit path A3 (i.e., $R3=L1_1+D1/2$) becomes longer than the radius R1 of the transit path A1 illustrated in FIG. 13A.

In this exemplary embodiment of the present invention, during the opening and closing of the transfer cover unit 8 and when the timing drive roller 32*a* passes by the parts of the main body 110, such as the intermediate transfer belt 16 and the drive roller 18, the rotary arm 45 is rotated due to the weight thereof in the counterclockwise direction to contact the stopper surface 52*b* of the support member 52. By so doing, the radius R1 of the transit path A1 can be shorter enough to avoid interference with the parts of the main body 110.

It is to be noted that, even if the rotary arm 45 is raised temporarily from the stopper surface 52*b* of the support member 52 due to shock during the opening and closing of the transfer cover unit 8, the pressure lever 46 that is in contact with the stopper 48 regulates the height of moving up from the stopper surface 52*b* of the support member 52, as illustrated in FIG. 13B (and FIG. 12B). With this regulation of height, the radius R2 of the transit path A2 of the timing drive roller 32*a* corresponds to $L1_2$+D1/2 at most, as illustrated in FIG. 13B, and therefore it is not likely that the timing drive roller 32*a* interferes with the intermediate transfer belt 16 and the drive roller 18.

However, with the transit path A1, the timing drive roller 32*a* cannot contact the timing driven roller 32*b* of the main body 110 even if the transfer cover unit 8 is completely closed. Therefore, after the timing drive roller 32*a* passes by the intermediate transfer belt 16 and the drive roller 18 and is moved to the lower portion thereof, the rotary shaft 32*a*1 of the timing drive roller 32*a* contacts the upper surface 55*c*1 of the lower jaw 55*c* of the positioning guide member 55, thereby rotating the rotary arm 45 in the clockwise direction. Further, at the same time, the rotary arm 45 is shifted in a direction to separate from the pivot 27*a* due to the biasing force between the pressure lever 46 and the tension spring 47.

By moving the timing drive roller 32*a* as described above while opening or closing the transfer cover unit 8, the configuration layout in which the timing drive roller 32*a* is disposed at the immediately lower portion of the intermediate transfer belt 16, that is, at the immediately low and inward (left side) portion of the drive roller 18 can be achieved. With this configuration layout, the size of the image forming apparatus 100 can be reduced in the inward direction and in the vertical direction thereof, thereby promoting the compact size of the image forming apparatus 100.

Figure 15:
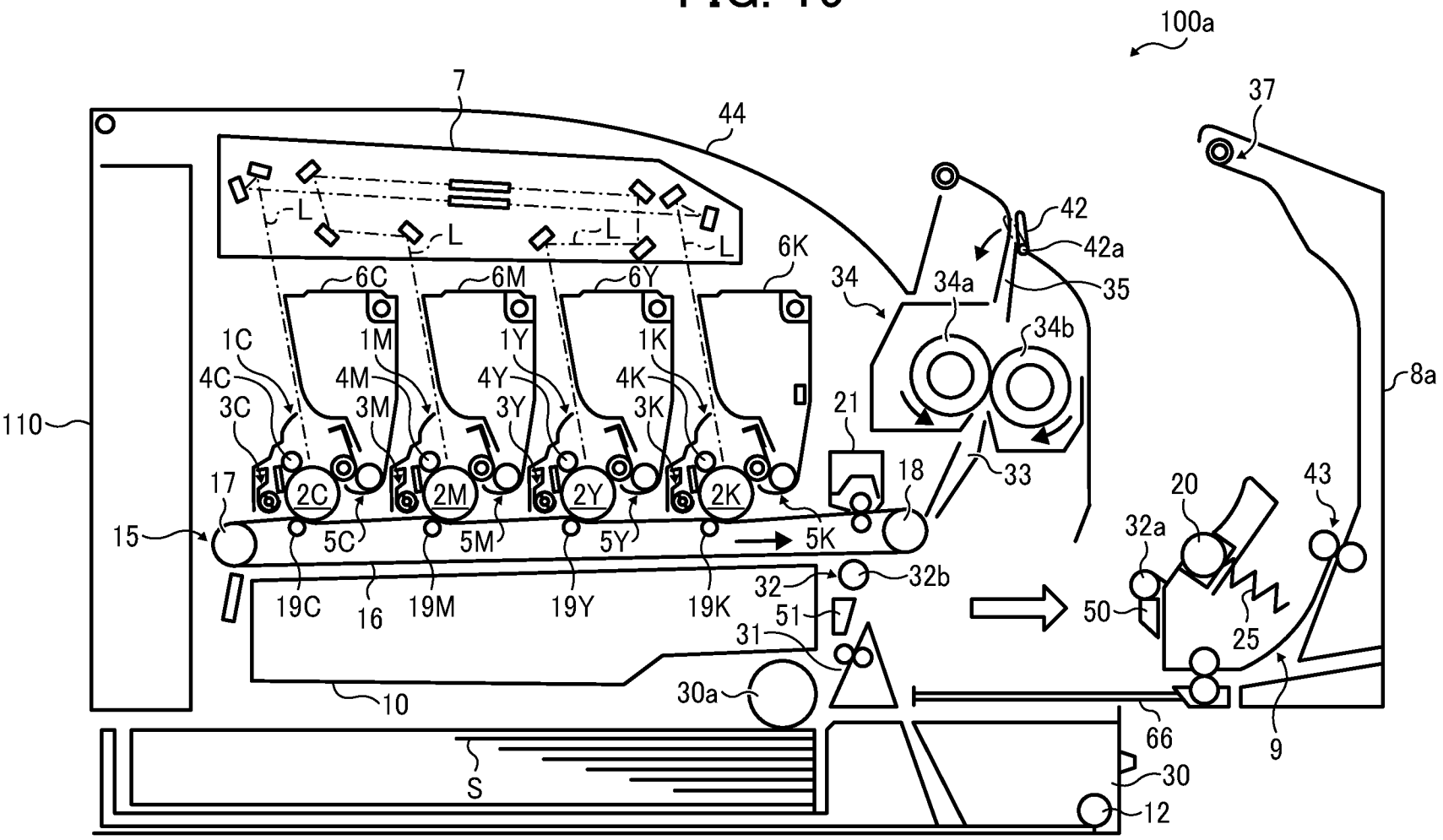
FIG. 15 is a cross-sectional view of the image forming apparatus according to a modification of the exemplary embodiment of the present invention.

FIG. 15 illustrates a modification of the embodiment of the present invention. In this modification, an image forming apparatus 100*a* includes a transfer cover unit 8*a* that does not rotate but slides outwardly or toward the front side of the image forming apparatus 110*a* in a horizontal direction along a horizontal rail 66 provided in the lower part of the image forming apparatus 100*a* to open the transfer cover unit 8*a*. The configuration of the image forming apparatus 100*a* is similar to the configuration of the image forming apparatus 100, except the transfer cover unit 8*a* slides inward and outward with respect to the front side of the image forming apparatus 100*a* while the transfer cover unit 8 of the image forming apparatus 100 rotates to open and close.

If the opening and closing method in the horizontal direction is employed to the image forming apparatus 100, the interference of the transfer roller 20 and the timing drive roller 32*a* on the transfer cover unit 8 with the parts of the main body 110 may be less possible along the compact structure of the image forming apparatus 100. However, the accuracy in positioning of the transfer roller 20 and the timing drive roller 32*a* may be adversely affected and the friction of the intermediate transfer belt 16 received from the transfer roller 20 may be a problem.

According to the exemplary embodiment of the present invention, the transfer roller 20 and the timing drive roller 32*a* can be correctly located to the final position by using the positioning guide member 55. Further, due to the guide shape of the positioning guide member 55, the final position can be raised higher than the height for horizontal shifting. By so doing, the position of the parts of the main body 110 can be lower in the middle of the movement of the transfer cover unit 8 for positioning the transfer roller 20 and the timing drive roller 32*a*, and therefore can promote the compact configuration of the image forming apparatus 100.

As described above, the exemplary embodiment of the present invention has been described. However, the present invention is not limited to the above-described exemplary embodiment and can be applied to variations. For example, the exemplary embodiment of the present invention can be applied to an image forming apparatus. However, it is needless to say that the present invention is applicable to a device other than an image forming apparatus. Further, the exemplary embodiment provides the timing driven roller 32*b*, the intermediate transfer belt 16, and the drive roller 18 as sheet feed members of the main body 110 and the timing drive roller 32*a* and the secondary transfer roller 20 as the sheet feed members of the transfer cover unit 8. The sheet feed member may be a roller or an endless belt.

Further, the sheet feed member may be a member other than for timing or transfer. For example, the pressure roller 34*b* of the fixing unit 34 can be repositioned to the transfer cover unit 8 and can be shifted by a positioning guide member provided to the main body 110 so as to avoid interference with the parts of the main body 110 in the vicinity of the fixing roller 34*a* that is disposed in the main body 110 of the image forming apparatus 100.

Further, the positioning guide member 55 is provided to guide the timing drive roller 32*a* in the exemplary embodiment of the present invention. However, a positioning guide member that is similar to the positioning guide member 55 can guide the secondary transfer roller 20. Further, in the exemplary embodiment of the present invention, two sheet feed members are provided in the main body 110 and the transfer cover unit 8. However, the number of sheet feed members may be one, three or more.

Further, the positions of the timing drive roller 32*a* and the timing driven roller 32*b* can be switched. Specifically, the timing drive roller 32*a* can be provided to the main body 110 of the image forming apparatus 100 and the timing driven roller 32*b* can be provided to the transfer cover unit 8, which is an opposite configuration to the exemplary embodiment of the present invention.

Further, the present invention can also be applied to an image forming apparatus for forming black-and-white images without the intermediate transfer belt 16. In the monochrome image forming apparatus, the intermediate transfer belt 16 may be replaced by a photoconductor drum that serves as an image carrier to press contact the transfer roller 20 provided in the transfer cover unit 8 to the outer circumferential surface of the photoconductor drum.

Further, in the exemplary embodiment, the transfer cover unit 8 includes the duplex unit 9. However, the transfer cover unit 8 without a duplex unit can also be applied.

The above-described embodiments are illustrative only and do not limit the present invention. Thus, numerous additional modifications and variations are possible in light of the above teachings. For example, elements or features of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet feeding mechanism, comprising:

a cover unit rotatably attached to one side of a main body of an image forming apparatus to cover a part of a sheet conveyance path;

a first feeding member located in the main body of the image forming apparatus;

a second feeding member located in the cover unit in a displaceable manner and facing the first feeding member when the cover unit is closed, the first feeding member and the second feeding member sandwiching and conveying a recording medium along the sheet conveyance path;

a guide member disposed in the main body to guide the second feeding member; and a rotary arm to support the second feeding member, wherein the guide member guides the second feeding member to move in a first direction that approaches the first feeding member when closing the cover unit, wherein the guide member further guides the second feeding member to move in a second direction that separates from the first feeding member when opening the cover unit, wherein the second feeding member moves in the first direction according to cooperation of the rotary arm and the guide member while the cover unit is closing, wherein the second feeding member moves in the second direction according to cooperation of the rotary arm and the guide member while the cover unit is opening, wherein the second feed member is biased in the first direction by an elastic member while the second feeding member is guided by the guide member, wherein a pressure lever is disposed between the elastic member and the rotary arm, wherein a biasing force of the elastic member is exerted in the first direction via the pressure lever and the rotary arm, and wherein after the second feeding member is supported by the guide member, when the rotary arm and the pressure lever contact, the biasing force of the elastic member is exerted on the second feeding member.

2. The sheet feeding mechanism according to claim 1, wherein the second feeding member is supported at a leading edge of the rotary arm, and a base end of the rotary arm is supported by the cover unit to be rotatable in the first direction and in the second direction.

3. The sheet feeding mechanism according to claim 1, wherein a regulated portion is formed on a side surface of the rotary arm to contact a regulating member formed on the cover unit in a width direction of the second feeding member.

4. The sheet feeding mechanism according to claim 3, wherein one of the regulated portion and the regulating member includes a slope to reduce play between the regulated portion and the regulating member.

5. The sheet feeding mechanism according to claim 4, wherein a regulated member of the rotary arm and a supporting portion of the second feeding member at the leading edge of the rotary arm are disposed offset in the width direction of the second feeding member.

6. The sheet feeding mechanism according to claim 1, wherein the biasing force of the pressure lever with respect to the rotary arm is released in a non-guided state in which the second feeding member is not guided by the guide member.

7. The sheet feeding mechanism according to claim 6, wherein, since the second feeding member is in the non-guide state, the rotary arm contacts a stopper surface mounted on the cover unit to regulate the position thereof.

8. The sheet feeding mechanism according to claim 1, wherein the pressure lever is rotatably supported by a pivot formed on the cover unit, wherein the regulating member of the cover unit is formed by a leading edge of the pivot.

9. The sheet feeding mechanism according to claim 1, further comprising a sheet feed guide disposed upstream from the second feeding member in the sheet conveyance direction, wherein a downstream end of the sheet feed guide is engaged with the second feeding member.

10. The sheet feeding mechanism according to claim 1, wherein a transit path of the cover unit is one of a straight line and an arc.

11. The sheet feeding mechanism according to claim 1, further comprising:

a third sheet feeding member located in the main body and downstream from the first sheet feeding member in the sheet conveyance direction; and a fourth sheet feeding member located in the cover unit in a displaceable manner, downstream from the second sheet feeding member in the sheet conveyance direction, and facing the third feeding member when the cover unit is closed, the third feeding member and the fourth feeding member sandwiching and conveying the recording medium along the sheet conveyance path, wherein, by moving in the second direction when opening or closing the cover unit, the second feeding member avoids interference with the third feeding member.

12. An image forming apparatus, comprising:

a writing device to optically write image data;

an image forming device to form an image based on the image data written by the writing device;

a transfer unit to transfer the image formed in the image forming device onto a recording medium;

a fixing unit to fix the image on the recording medium;

a sheet conveyance path through which the image-fixed recording medium travels from the transfer unit via the fixing unit to a sheet discharging unit; and the sheet feeding mechanism according to claim 1, disposed on the sheet conveyance path.

13. The image forming apparatus according to claim 12, further comprising: a third sheet feeding member located in the main body and downstream from the first sheet feeding member in the sheet conveyance direction; and a fourth sheet feeding member located in the cover unit in a displaceable manner, downstream from the second sheet feeding member in the sheet conveyance direction, and facing the third feeding member when the cover unit is closed, wherein the third feeding member and the fourth feeding member sandwich and convey the recording medium along the sheet conveyance path, wherein, by moving in the second direction when opening or closing the cover unit, the second feeding member avoids interference with the third feeding member, wherein the first feeding member and the second feeding member are a pair of timing rollers and the third feeding member and the fourth feeding member are a pair of transfer rollers.

14. The image forming apparatus according to claim 12, wherein the cover unit comprises a duplex unit disposed therein.

15. The image forming apparatus according to claim 12, configured as a multi-functional apparatus having two or more functions of a copier, a printer, and a facsimile machine.

16. The sheet feeding mechanism according to claim 1, wherein a contact surface of the pressure lever rotatably contacts a contact surface of the rotary arm and the rotary arm have different pivot by the biasing force exerted by the elastic member is exerted.

17. The sheet feeding mechanism according to claim 1, wherein when the pressure lever and the rotary arm are not in contact when the transfer cover is in an open state.

* * * * *